US006158142A

United States Patent [19]

Brauch et al.

[11] Patent Number: 6,158,142

[45] Date of Patent: Dec. 12, 2000

[54] METHOD OF AND APPARATUS FOR DRYING AND CONVEYING SCREENINGS

[75] Inventors: Joseph Karl Brauch, Littleton; Charles Lonnie Meurer, Golden; Douglas Lee Meurer, Denver; James Malcolm Meurer, Wheat Ridge, all of Colo.

[73] Assignee: Meurer Industries, Inc., Golden, Colo.

[21] Appl. No.: 09/121,165

[22] Filed: Jul. 23, 1998

[51] Int. Cl.[7] ..... F26B 9/04

[52] U.S. Cl. ..... 34/144; 100/126; 210/227

[58] Field of Search ..... 34/95, 143, 144, 34/380, 381, 382, 388, 398; 100/110, 116, 126, 244, 264; 210/227, 380, 791, 800, 802; 44/552, 577, 578

[56] References Cited

U.S. PATENT DOCUMENTS

| | | | |
|---|---|---|---|
| 2,379,615 | 7/1945 | Walker | 210/176 |
| 2,897,967 | 8/1959 | Arthur | 210/173 |
| 2,930,485 | 3/1960 | Nordell | 210/158 |
| 3,613,564 | 10/1971 | Adamski | 100/118 |
| 4,245,396 | 1/1981 | Maffet | 34/391 X |
| 4,865,753 | 9/1989 | Meurer | 210/802 |
| 5,116,443 | 5/1992 | Meurer | 156/209 |
| 5,125,931 | 6/1992 | Schulz | 44/552 |
| 5,391,306 | 2/1995 | Meurer | 210/802 |
| 5,510,025 | 4/1996 | Benesi | 210/227 |
| 5,692,435 | 12/1997 | Nissen | 100/126 |

OTHER PUBLICATIONS

Wilkerson Instrument Co., Inc.; Mighty Module, Dec. 1997, Company Brochure 2207; 2 pages.

Helisieve™Hycor Corporation; Helisieve™, Jan. 1993, Company Brochure, 2 sides, 1 sheet.

Hycor Corp.; Helisieve Plus; Apr. 1994, Company Brochure, 2 sides, 1 sheet.

Hycor Corp.; Helixpress™; Oct. 1993, Company Brochure, 2 sides, 1 sheet.

Hycor Corp.; Screenings; Jan. 1994, Residuals Management Newsletter; 4 pages.

Hycor Corp.; Jan., 1993; Heliclean™Brochure; Company Brochure, 4 pages.

*Primary Examiner*—Stephen Gravini
*Attorney, Agent, or Firm*—C. E. Martine, Jr.

[57] ABSTRACT

A vise having vise members is provided with a vise face on each vise member. The vise faces are opposed and together define an initial vise volume having an open top for receiving loose, wet screenings. The vise faces form jaws moved relative to each other to squeeze the loose, wet screenings, which is a process of enclosing and applying force to the loose, wet screenings to compress the screenings and force the liquid out of or from the material of the screenings. The squeezing makes a loaf volume significantly smaller than the initial volume, and converts the loose wet screenings into a separate dry loaf. A platform has many separate stations. At one station (e.g., receiving & squeezing), a bottom of the trough is sieve-like for draining the liquid from the wet screenings. At another station (e.g., conveying), the bottom of the platform is closed to retain the separate dry loaf of screenings for conveying. At another station (e.g., discharge), the bottom is open to allow the discharge of one loaf of the screenings from the platform, which supports the screenings (but not the liquid) between the opposed vise faces while the vise faces move relative to each other to squeeze the screenings (allowing the liquid to drain from the squeezed screenings). The vise may be located over the flow channel of the screen so that the liquid drains out of the vise and flows directly down into the channel.

40 Claims, 31 Drawing Sheets

FIG. 17

Step 500: dropping the loose wet screenings 102 into the opening between the opposed vise faces 127.

Step 501: providing the support track 163 below the vise faces 127 to retain the loose wet screenings 102 between the opposed vise faces 127.

Step 502: moving the vise faces 127 toward each other to squeeze and dry the screenings 102.

FIG. 18

Step 502A: By the moving step 502, immediately starting to compress the screenings 102 upon initiation of the moving of the opposed vise faces 127.

FIG. 19

Step 502B: Performing the moving step 502 a plurality of times.

Step 502C: moving the vise faces 127 away from each other before the next moving step 502B is performed.

FIG. 20

Step 510: after defining the loaf 123, conveying the vise faces 127 and the loaf 123 to a discharge station while the loaf 123 is supported by the support track 163 and is between the vise faces 127.

Step 511: providing the opening 142 in the support track 163 at the second drier station DIS to permit discharge of the loaf 123 from between the vise faces 127.

FIG. 21

Step 550: at the end of each operating cycle of the screen 103, dropping the wet loose screenings 102 into an open top 134 between the opposed vise faces 127.

Step 551: providing the support track 163 below the open bottom 136 to retain the loose wet screenings 102 between the opposed vise faces 127.

Step 552: after each cycle of the screen 103, moving the vise faces 127 toward each other to squeeze and dry the screenings 102.

FIG. 22

Step 575: dropping the wet loose screenings 102 into the opening between opposed vise faces 127.

Step 576: providing the support track 163 below the open bottom 136 to retain the loose wet screenings 102 between the opposed vise faces 127.

Step 577: moving the vise faces 127 toward each other to squeeze and dry the screenings 102 between the opposed vise faces 127 to define the loaf 123 of dry screenings 102.

Step 578: moving the vise faces 127 and the loaf 123 as a single unit to the discharge station DIS.

Step 579: moving the vise faces 127 away from each other to release the loaf 123 for discharge from the drier 101.

METHOD OF AND APPARATUS FOR DRYING AND CONVEYING SCREENINGS

BACKGROUND OF THE INVENTION

1. Field of the Invention

This invention relates to drying solid materials, and more particularly, to squeezing a volume of wet, solid materials to reduce the liquid content and volume of the solid materials, and to moving those materials after reducing the liquid content and volume of the solid materials; which solid materials may be non-degradable screenings previously removed from liquid flowing into a water or waste water or liquid industrial waste treatment facility.

2. Discussion of Prior Driers

Basins are used to remove certain undesired solid materials from liquid, to clarify the liquid. Basins are used, for example, in water and waste water treatment plants, and in industrial waste treatment plants. In water treatment, water drawn from a water supply has various undesired solid materials therein. One type of undesired material is non-settleable colloidal solid material. When mixed with chemicals, the non-settleable colloidal solid materials and the chemicals agglomerate to form solid materials which will settle from the water. In water and waste water treatment, the undesired solid materials include organic solids. In industrial processes, the undesired solid materials may include a variety of materials, such as fibers, which are not amenable to agglomeration and settling, for example.

Water, waste water, and liquid industrial wastes are treated in basins to remove such undesired solid materials, thereby making the water clear and suitable for use, reuse, or for further treatment, such as tertiary treatment. The word "liquid" as used below to describe the present invention refers to water, waste water and liquid industrial wastes.

These undesired solid materials include particles that are suspended in the liquid. Devices for removing the suspended materials are well-known. Such devices substantially reduce the flow rate of the liquid, and the particles therein, as in a very low flow, or quiescent, zone (or flow channel) in the basin. The suspended, low flow rate particles are subjected to the force of gravity and settle to the bottom of the basin as sludge.

However, the undesired solid materials to be removed from such liquid include items that are generally much larger than such suspended, settleable materials, and that are not removable by settling. Many of these larger materials are not regulated by government waste management authorities. These larger materials may therefore be disposed of in land fills, and include, for example, (i) man-made materials such as plastic shapes for holding six cans of soda in a six-pack; (ii) large materials such as other plastic waste, containers, construction debris, and refuse carried by, but generally not suspended in, liquid; and (iii) many other materials (such as paper towels) which are carried by the liquid, but which generally do not degrade in the manner in which bio-degradable materials (such as food) degrade.

To differentiate the undesired, suspended, settleable solid materials from such other undesired, non-settleable larger materials, these undesired, suspended, settleable solid materials are referred to herein as "settleable solids", which are removed by "settlers". The undesired items that are generally much larger than such settleable solids, and that are not removable by settling, are referred to herein as "screenable solid materials", or "screenings", because they are desirably removed by a "screen" that performs a screening process before the liquid and the settleable solids flow into the basin. The screenings (or screenable solid materials) are the materials processed according to the principles of the present invention.

If such screenings are not removed before the liquid and the settleable solids flow into the basin, (a) such screenings may interfere with the settling process during which the settleable solids are encouraged to settle to the bottom of the basin and form sludge, (b) such screenings in the sludge may interfere with removal of the sludge from the basin, and (c) the sludge collected from the bottom of the basin will include some of the screenings. Such interference with the settling process is undesirable because less settleable solids are removed per gallon of liquid processed through the settler. Also, the sludge is temporarily stored ("inventoried") before use, such that any excess (i.e., non-settleable solid) material in the inventoried sludge increases the land area, or size of other facilities, needed to store the sludge. Further, because such screenings (e.g., plastics) are not suitable for use in the manner in which the sludge is used (e.g., fertilizer for agricultural purposes), the commercial value of sludge which contains screenings is greatly reduced, increasing the net cost of the liquid clarifying operation.

Accordingly, efforts have been made to provide ways of removing screenings from the liquid and from the settleable solids before the liquid and the settleable solids flow into the basin. Applicants have previously provided improved facilities for removing the screenings from the liquid and the settleable solids before the liquid and the settleable solids flow into the basin. For example, such facilities have provided (a) a simple, lower-cost, automatic, programmed fixed bar screen cleaner; (b) a bar screen cleaner which is universally usable as either a front rake-type or a back rake-type, and which is readily convertible at a basin of a plant for either type of operation; and (c) a bar screen cleaner which is simultaneously usable for both types of raking. These bar screen cleaners are applicable, for example, to basin supply channels, or channels, constructed on low budgets, such as for small plants in which choppers are currently used, as well as for large plants. Bar screen cleaners are referred to herein as "screens", and generally operate to remove the screenings from the bar screen by reciprocating across bars of the screen. This reciprocation tends to remove the screenings from the screen in "batches" (i.e., with the screenings gathered in one group, followed by more screenings in a later separate group, rather than removing the screenings continuously.

The screenings removed from the liquid and from the settleable solids are generally wet with the liquid and are loose, having a low density (a relatively large volume for the weight of the screenings). The liquid that wets the screenings may be absorbed by the materials which compose the screenings, or, for example, the liquid may be on the surface of such materials which compose the screenings. To remove some of the liquid with which the screenings are wet, and to reduce the volume of the screenings, others have used hydraulic drives to move a piston in a cylinder. However, the hydraulic drives generally take up significant amounts of room, which may not be available adjacent to a screen. Also, the screenings are generally fed to the cylinder via an open receptacle positioned axially spaced from the cylinder. An initial portion of the stroke of the piston is used to force the screenings from the receptacle into the cylinder. As a result, the initial portion of the stroke does not immediately compress the debris. Thus, the initial portion of the stroke may be referred to as "lost motion" which increases the time required for the compressing operation, for example. Also, a batch of the screenings from the receptacle usually remains in the cylinder as a compressed batch of screenings, and remains in the cylinder with one or more previously compressed batches of screenings. Because the piston must move and compress not only a new batch of screenings, but the prior batches of screenings which remain in the cylinder, more power is needed to move the multiple batches of compressed screenings out of the cylinder.

Others have used augers which compress and move such screenings along a tube which contains the auger. However, the force that the auger can apply to the screenings is less than that of the piston, such that less compression of the screenings takes place. Also, the auger moves the compressed screenings within a tube to a discharge point, such that successive batches of the screenings remain in the tube until they are advanced to the end of the tube.

In both the piston/cylinder and the auger examples, problems arise because of the time during which the compressed screenings remain in the cylinder or tube. For example, the amount of screenings flowing in the channel to the screen may vary widely. As a result, the volume of loose, wet screenings to be processed also may vary widely. If some screenings have been forced into the auger tube or into the piston cylinder, and then there is a substantial decrease in the amount of screenings to be processed by the screen, the screenings already in either such cylinders or tubes will stay there awaiting the next batch, or batches, of screenings to be compressed. Those next batches are necessary for pushing the initial batch(es) out of the cylinder or tube. As a result of the many batches in the cylinders or tubes, odors are emitted from the compressed batches of screenings during the time period in which these batches remain in the cylinder or tube awaiting the next batch or batches from the screen. Also, flammable gases (e.g., methane) emitted from the compressed screenings increase the risk of fire in the cylinders or tubes.

An additional problem of significance is that if the screenings from the auger or piston are to be acceptable for disposal in a landfill, they must be in the form of "dry waste". Dry waste does not exhibit "free water". However, in the auger case, for example, the force that may be applied to the screenings may be insufficient to dry the screenings so that they do not exhibit free water. A test for free water, or dryness, that is used to determine whether screenings have been dried enough for disposal in a landfill is a paint filter test in which material is placed in a standard conical filter which is used to filter paint (the "Filter Test"). The requirement for lack of free water in the screenings is that the screenings are dry enough for landfill disposal only if no liquid drips from such a paint filter after the screenings have been in the paint filter for a specified number of minutes. For example, reference may be made to Method 9095, SW-846, of the Environmental Protection Agency (USEPA 1991h). In the context of the present invention, screenings which pass the Filter Test are said to be "dry", and the process of rendering the screenings "dry" (i.e., without free water) so as to pass such Filter Test is referred to herein as "drying" or "dewatering". On the other hand, screenings which would not (or do not) pass the Filter Test, are said to be "wet". The efficiency of drying is defined as a percent based on the water in a batch of the screenings with respect to the total weight of the non-settleable materials and the water in such batch.

SUMMARY OF THE PRESENT INVENTION

In view of these and other problems not solved by various types of prior devices which attempt to remove liquid with which the screenings are wet and which attempt to reduce the volume of the screenings, there is still an unfilled need for safe and efficient equipment for reducing the liquid content and volume of screenings to avoid free water, and, after drying the wet screenings, for moving the dry screenings to a discharge station.

Applicants' studies of these problems indicate that the efficiency of operations for drying and conveying screenings to produce dry waste is fostered by providing an improved vise for both drying and conveying the loose, wet screenings after removal from the screen channel. The term "loose" is used to identify such screenings in the condition and form in which they are generally delivered from the channel by the screen. These loose screenings are generally not compacted, are delivered from the channel in separate batches, and are "wet" in the sense that the liquid either readily drips from the batch of the screenings or, if tested using the Filter Test, liquid drips through the filter and the screenings "fail" the Filter Test.

Applicants' studies of these problems indicate that efficient drying and conveying of a batch of the loose, wet screenings forms such screenings into a "loaf" of screenings that is separate from other dried screenings. The loose, wet screenings may have an initial volume of "x" cubic inches, for example. The separate loaf of screenings is a three dimensional mass (or unit) of dry screenings having a loaf volume of "y" cubic inches, for example, where "x" is many times more than "y". For example, "x" may be 3500 cubic inches, and "y" may be 72 cubic inches, such that the amount by which "x" exceeds "y" may be about 50 times.

The batch of screenable solid materials that forms the loaf may be said to have been dried or dewatered, indicating that enough of the liquid has been removed from the batch of screenings to enable the loaf, and the screenings of the loaf, to pass the Filter Test. The process of removing enough liquid to produce dewatered or dried screenable solid materials is referred to as "dewatering" or "drying". The efficiency of such drying or dewatering is defined as a percent based on the water in the initial batch of the screenings with respect to the total weight of the non-settleable materials and the water in the resulting loaf of dry screenings.

Such efficient drying and conveying uses a vise having vise members, wherein each of the vise members has a vise face. The present invention contemplates that the vise faces are opposed to each other and together define an initial vise volume having an open top for receiving the loose, wet screenings. The vise faces serve as jaws which are moved relative to each other to "squeeze" the loose, wet screenings. Such squeezing is a process of enclosing (at least partially), and applying force to, the loose, wet screenings to compress the screenings and force the liquid out of or from the material of the screenings. If the enclosing is at least partial, the squeezing makes the loaf volume ("y" in the above example) significantly smaller than the initial volume of the loose wet screenings ("x" in the above example), and converts the loose wet screenings into the separate dry loaf.

In another aspect of the vise of the present invention, Applicant's studies indicate that a platform, or trough, may be provided. The vise faces operate in conjunction with the trough, which has many separate locations, or stations. At one station (e.g., receiving/squeezing), a bottom of the trough is perforated, such as being sieve-like, for facilitating draining of the liquid from the wet screenings, such as when the receiving and squeezing take place. At another station (e.g., conveying), the bottom of the trough is closed to retain the separate dry loaf of screenings in the trough for conveying. At another station (e.g., discharge), the bottom is open to allow the discharge of one loaf of the screenings from the trough. The trough thus supports the screenings (but not the liquid) between the opposed vise faces while the vise faces move relative to each other to squeeze the screenings (allowing the liquid to drain from the squeezed screenings).

In another aspect of the vise of the present invention, Applicant's studies indicate that the trough should also support the dry separate loaf for transport to a discharge station.

The present invention also contemplates a drive for moving the vise members toward each other to immediately reduce the size of the vise volume and thus immediately squeeze the loose, wet screenings to form the loaf while the open top remains open, such that there is no lost motion prior to commencing the squeezing.

The present invention also contemplates making the squeezing process more efficient by forming and conveying such a loaf of screenings using such a vise. The vise has opposed first and second jaws. The trough is connected to the second jaw and has a guide track extending from a first of the stations (e.g., receiving/squeezing) to a second of the stations (e.g., discharge). At the first station the screenings in the loose, wet form are received through the open top of, and between, the first and second jaws. The first jaw is carried by the second jaw for movement relative to the second jaw to form the loaf from the loose, wet screenings. Also, the first jaw is carried by the second jaw for movement with the second jaw relative to the trough to convey the loaf from the first station to the second station. The loaf is discharged from the vise at the second station.

Applicants have further determined that the squeezing process may be provided with other advantages if the vise is located over the flow channel of the screen. The screen moves the screenings in the loose, wet condition out of the liquid to a position above the channel. The vise has the vise members, each of the vise members having a vise face, where the vise faces are mounted above and vertically aligned with the channel. The vise faces are opposed to each other and define the initial vise volume having the open top for receiving the loose, wet screenings. The drive moves the vise members relative to each other to reduce the size of the initial vise volume to the loaf volume. The trough bottom is perforated to allow the liquid from the wet squeezed screenings to drain, or flow out of the vise volume, during squeezing. With the vise faces mounted above and vertically aligned with the channel, the liquid that drains or flows out of the vise or loaf volume flows directly down into the channel, avoiding undesired handling of the liquid. At the discharge station, the bottom of the trough is open for discharging one such loaf. With the loaf conveyed to the discharge station, which is out of vertical alignment with the channel, the discharged loaf does not return to the channel.

Applicants have further determined that many of such problems can be avoided if there is loaf-by-loaf discharge from the dryer. To implement such discharge, such a vise is used with a guide such as the trough, which is connected to the second jaw and has the guide track extending from the first station to the second station. At the first station the trough is either continuous or perforated, and supports the loose and wet screenings between the first and second jaws during squeezing. The trough is discontinuous, or open, at the second station to permit the loaf to move from the vise at the second station. The second jaw carries the first jaw for movement with the second jaw relative to the trough. In one form of the present invention, the drive is connected to the first jaw to move both of the jaws along the guide track. A controller is provided for the drive. The controller causes the drive to move the first jaw toward the second jaw at the first station to define the loaf, and causes the first jaw to move away from the second jaw at the second station to permit the loaf to move from the vise.

One aspect of the controller for one form of the present invention is the provision of a third station (e.g., squeezed) provided to identify, or define, the position of the first jaw at the end of the squeezing (i.e., when the loaf has been defined). Another aspect of the controller is a first barrier on the trough in the path of the second jaw for stopping the second jaw adjacent to the first station. A sensor responsive to the first jaw at the third station reverses the direction of motion of the first jaw.

Yet another aspect of the controller for one form of the present invention is the provision of a fourth station (e.g., first jaw discharge) to identify, or define, the position of the first jaw when the loaf is positioned at the second station. A second barrier is provided on the trough in the path of the second jaw for stopping the second jaw adjacent to the second station. A sensor is responsive to the first jaw at the fourth station for reversing the direction of motion of the first jaw.

In another aspect of the vise, one form of the present invention contemplates that the trough is slidably connected to the second jaw, and the trough has the guide track extending from the first and third stations to the second and fourth stations. The respective first and second jaws are spaced apart by the squeezed screenings when the respective first and second jaws are at the respective third and first stations. The respective first and second jaws are spaced apart when the respective first and second jaws are at the respective fourth and second stations, with the spacing being enough to permit the loaf to move from between the jaws. Between the first and second stations the trough is continuous to support the screenings (which are between the first and second jaws) in the loose, wet form as received from the screen, whereas the trough is discontinuous between the second and fourth stations to permit the loaf to move, such as by falling, from the vise at the second station.

Another form of the present invention contemplates that the trough may also be provided with a fifth station (e.g., jaws open) spaced from the second station on a side of the first station opposite to the second station. The controller may further have a first sensor for causing the drive to move a second jaw to the fifth station and to cause a first jaw to move to the first station. A first stop in the path of the first jaw stops the first jaw at the first station while the second jaw moves to the fifth station.

The other form of the present invention contemplates a controller that also causes the drive to move the second jaw from the fifth station toward the fourth station. A detent connects the first jaw to the trough to hold the first jaw at the first station as the second jaw moves from the fifth station toward the fourth station. The controller may also cause the drive to move the second jaw from the fifth station past the second station toward the fourth station. As the second jaw moves from the fifth station past the second station toward the fourth station, the detent releases the first jaw to permit the first jaw to move with the second jaw toward the fourth station.

Yet another aspect of the controller for one form of the present invention contemplates providing the controller with a first stop in the path of the second jaw for stopping the second jaw at the second station while the first jaw moves to the fourth station. Another detent releasably connects the first jaw to the second jaw upon the arrival of the first jaw at the fourth station. A stop in the path of the second jaw overrides that detent and interrupts motion of the second jaw at the first station. The controller causes the first jaw to move past the first station while the second jaw is stopped by the stop at the first station so that the wet, loose screenings between the first and second jaws are formed into the loaf.

A still other aspect of one form of the present invention contemplates providing a force multiplying unit between each end of a first jaw member of a vise and a respective opposed end of a second jaw member, so that with multiplied force the first jaw member forces a first jaw of the first jaw member toward a second jaw of the second jaw member.

Applicants have also determined that a method of processing screenings loaf-by-loaf may also have advantages lacking in the prior devices which attempt to remove liquid with which the screenings are wet and attempt to reduce the volume of the screenings. The present invention contemplates that the loose, wet screenings are formed into the loaf, which is the single three dimensional mass of compressed dry screenings, by steps including dropping the wet loose screenings into an opening between opposed vise faces. A support is provided below the opening to retain the loose, wet screenings in the opening between the opposed vise faces. The vise faces are moved toward each other to squeeze the screenings between the opposed vise faces. One aspect of the method is that the moving step immediately starts to squeeze the screenings upon initiation of the moving of at least one of the opposed vise faces.

Yet another aspect of one form of the present invention contemplates performing the moving step a plurality of times, and moving the opposed vise faces away from each other before the next moving step is performed. This facilitates multiple squeezing of one batch of the screenings.

Applicants have also determined that effective and safe drying and compacting may result from a method of moving the vise faces and the loaf to a discharge station while the loaf is supported by the trough and is between the vise faces. A step of the method is providing an opening in the trough at the discharge station to permit discharge of the loaf from between the vise faces.

Another aspect of the method contemplates forming loose, wet screenings into a single three dimensional loaf of compressed dry screenings. The screenings are supplied to the vise from a screen having a plurality of operating cycles. The method includes, at the end of each screen cycle, the step of dropping the wet loose screenings into an opening between opposed press faces. A support is provided below the opening to retain the loose, wet screenings in the opening between the opposed press faces. In coordination with the cycles of the screen, the vise faces are moved relative to each other to squeeze the screenings between the opposed vise faces. Also, the vise faces and the loaf may be moved as a single unit to the discharge station, and the vise faces may then be moved relative to each other to release the loaf.

BRIEF DESCRIPTION OF THE DRAWINGS

Other features and advantages of the present invention will be apparent from an examination of the following detailed description, which includes the attached drawings in which:

FIGS. 17 through 22 are flow charts illustrating various aspects of the method of the present invention.

DETAILED DESCRIPTION OF THE PREFERRED EMBODIMENTS

Bar Screen Cleaner 40

Figure 1A:
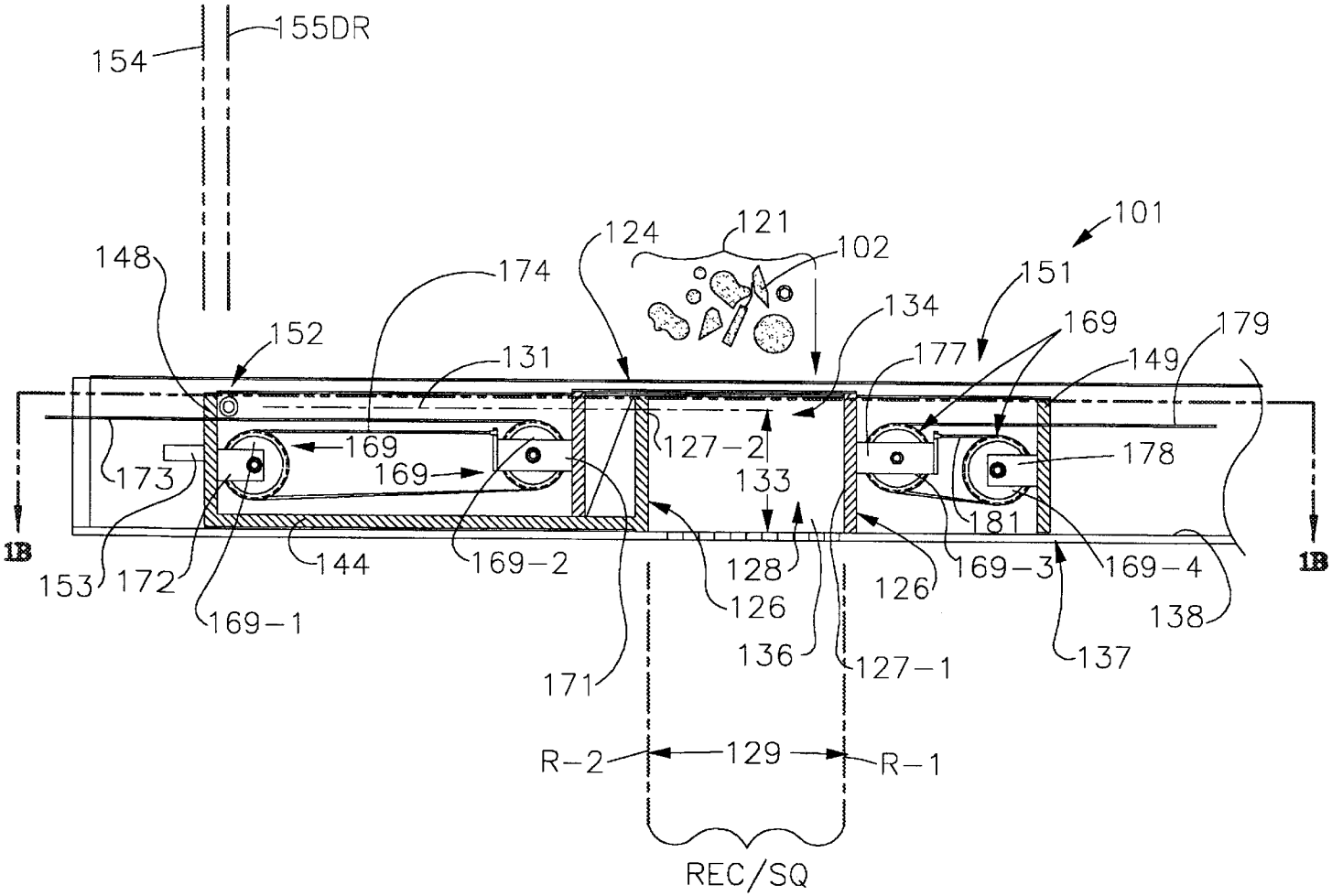
FIG. 1A is an elevational view of one embodiment of the present invention showing first and second jaws of opposed vise members in an open position receiving wet loose screenings.
Figure 14:
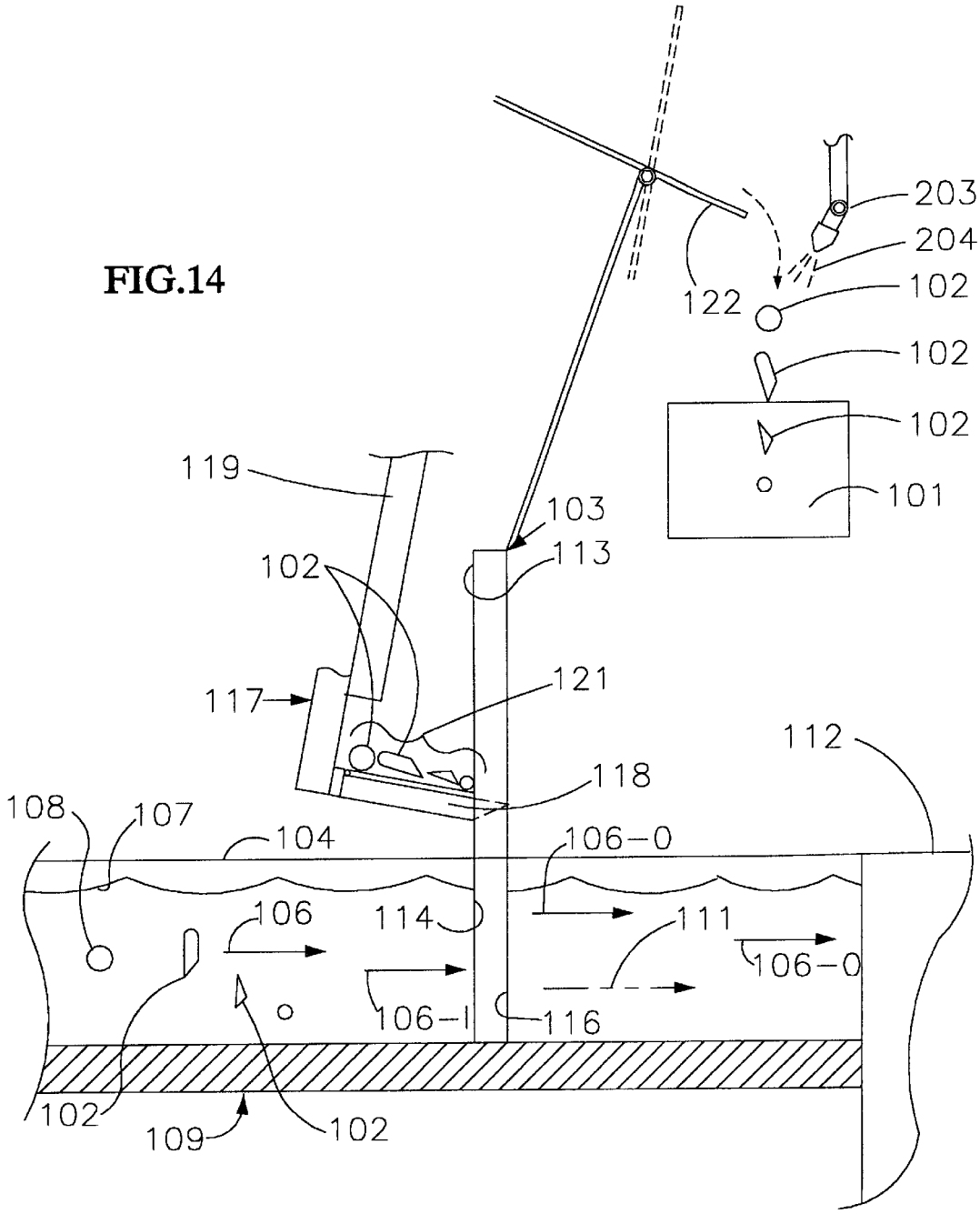
FIG. 14 is an elevational view showing a screen which may be used to provide batches of the loose wet screenings to the driers of the present invention.

FIGS. 1A and 14 show a drier 101 of the present invention for receiving wet loose screenings 102 from, for example, a screen 103 which removes the screenings 102 from a channel 104 which guides a flow stream (shown by arrows 106). The flow stream 106 may include liquid 107, solids 108, and the screenings 102 which flow together from an upstream end 109 of the channel 104 to the screen 103. The flow stream 106 is generally along a longitudinal axis 111 of the channel 104.

The screen 103 is designed to prevent the screenings 102 from flowing to a liquid treatment basin 112 downstream of the screen 103. The channel 104 guides the liquid 107 and the solids 108 downstream from the screen 103 to the basin 112. The screen 103 may have an upper end 113, a front side (or face) 114 facing the upstream (incoming) flow stream 106-I, and a back side 116 facing the downstream (outgoing) flow stream 106-O. A rake 117 has tines 118 for engaging the screen 103 to move the loose wet screenings 102 upwardly along the screen 103. A frame 119 supports the rake 117 relative to the screen 103 to provide front or back raking operations. For example, in a first rake position shown in FIG. 14 for front raking, the tines 118 are engagable with the front face 114 of the screen 103 to move a batch, or group, 121 of the wet loose screenings 102 toward and past the upper end 113 of the screen 103 to remove the batch 121 of the screenings 102 from the screen 103. The tines 118 direct the batch 121 to a chute 122, for example, which guides the batch 121 to the drier 101 of the present invention for squeezing the wet loose screenings 102 to form the wet loose screenings 102 into a loaf 123 of dry waste (FIGS. 4A and 4B), and conveying the loaf 123. The loaf 123 of dry waste includes the screenings 102 (which are the "screenable solid materials" as defined above) that have been dried or dewatered, as defined above. The "dry" in "dry waste" indicates that enough of the liquid 107 has been removed from the batch 121 to enable the loaf 123, and the now-dry screenings 102 of the loaf 123, to pass the Filter Test, such that there is no free water in the loaf 123.

Squeezing Facilities

A first embodiment of the present invention is shown in FIGS. 1A through 6B as the drier 101 for producing the loaf 123 of dry waste from the loose wet screenings 102. FIGS. 1A and 1B show a vise 124 having vise members 126. Each of the vise members 126 has a squeezer face 127. The squeezer faces 127 are opposed to each other and define an initial vise volume 128 having a length 129 parallel to a squeezing axis 131, a width 132 (FIG. 1B) perpendicular to the squeezing axis 131, and a height 133. The initial vise volume 128 defined by the squeezer faces 127 also has an open top 134 for receiving the loose wet screenings 102 and has an open bottom 136 for discharging the loaf 123 of dry waste. A platform, such as a trough, 137 is provided having a surface 138 for supporting the loose wet screenings 102 in the initial vise volume 128 between the opposed squeezer faces 127. FIGS. 3A and 3B show a driver 139 moving the vise members 126 relative to each other to immediately, without any lost motion prior to commencing the compressing, reduce the size of the initial vise volume 128 and compress the loose wet screenings 102 while the open top 134 remains open. The initial volume 128 is reduced to a partially squeezed volume 130 (FIG. 3A). FIGS. 4A and 4B show the former loose wet screenings 102 as the loaf 123 of dry waste having a dry volume 141 substantially less than the initial vise volume 128 of the loose wet screenings 102.

Figure 4A:
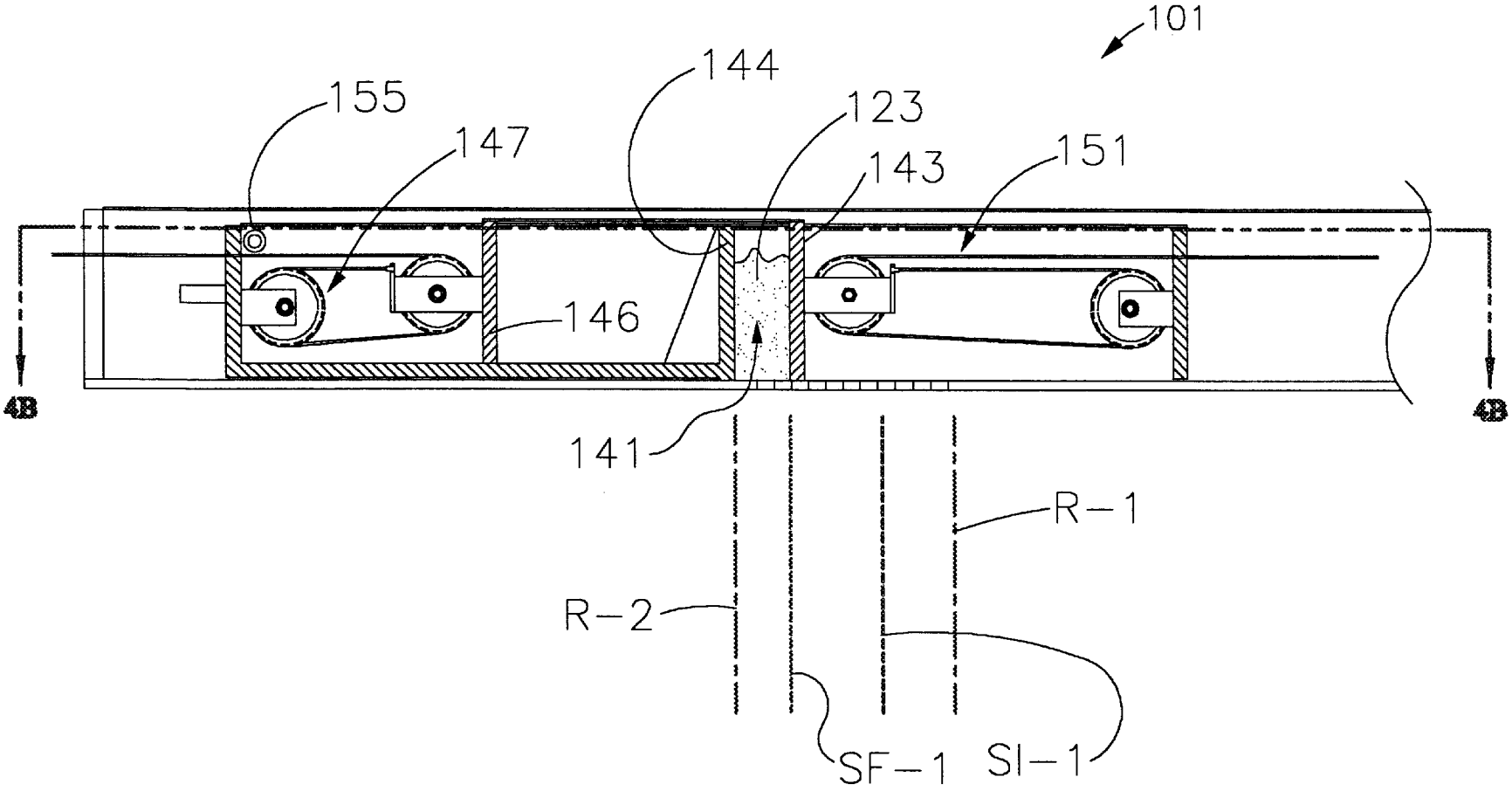
FIG. 4A is an elevational view of the embodiment of the present invention shown in FIGS. 1A, 2A, and 3A, illustrating the first and second jaws of opposed vise members in a fully closed position, wherein the formerly wet loose screenings are shown as a loaf of dry waste having substantially reduced volume, with the dry waste resting on the sieve-like floor of the trough.
Figure 4B:
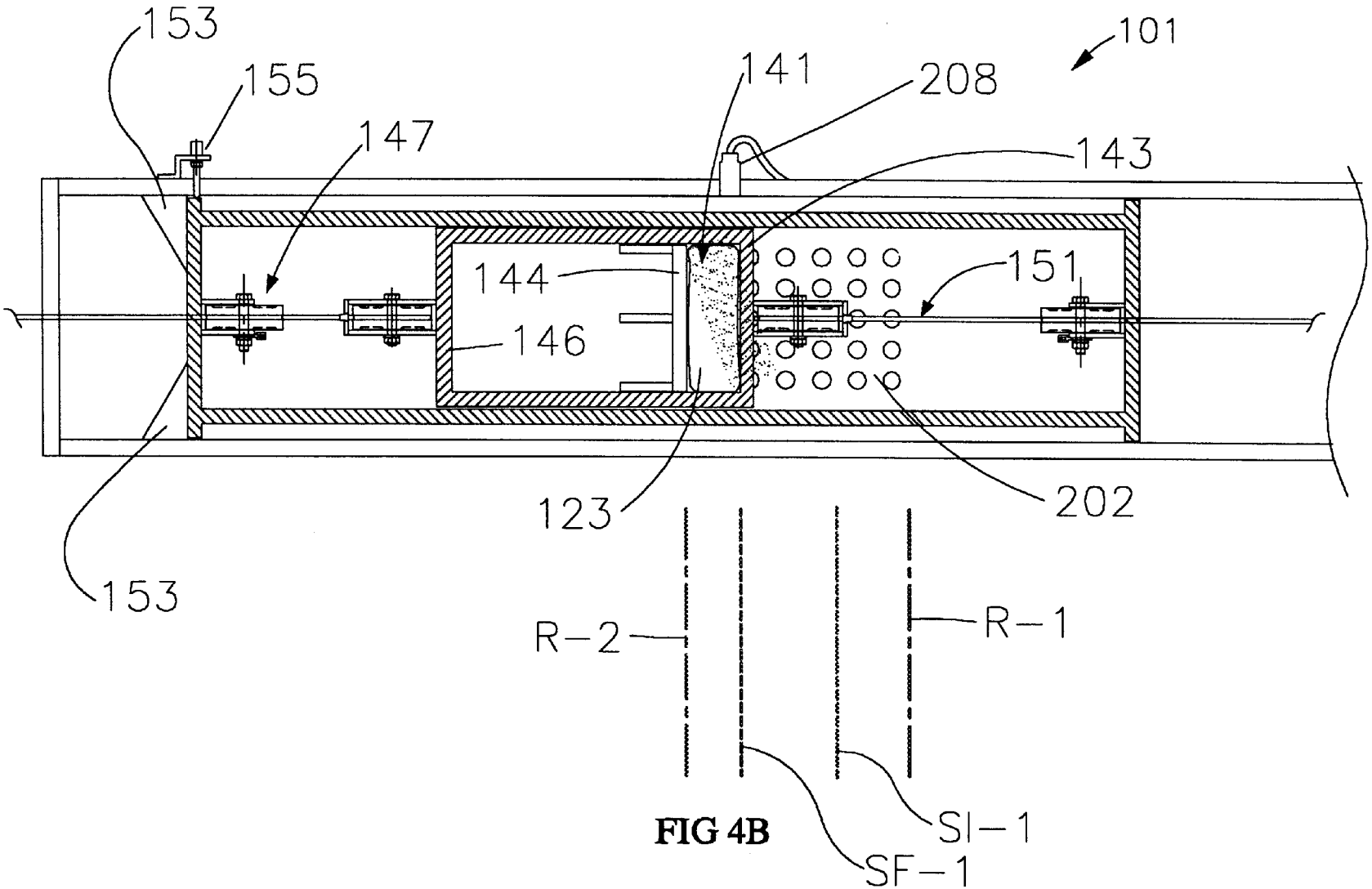
FIG. 4B is a plan view taken along line 4B—4B in FIG. 4A showing the completed squeezing and a left one of the force multipliers having pulleys close together.
Figure 5A:
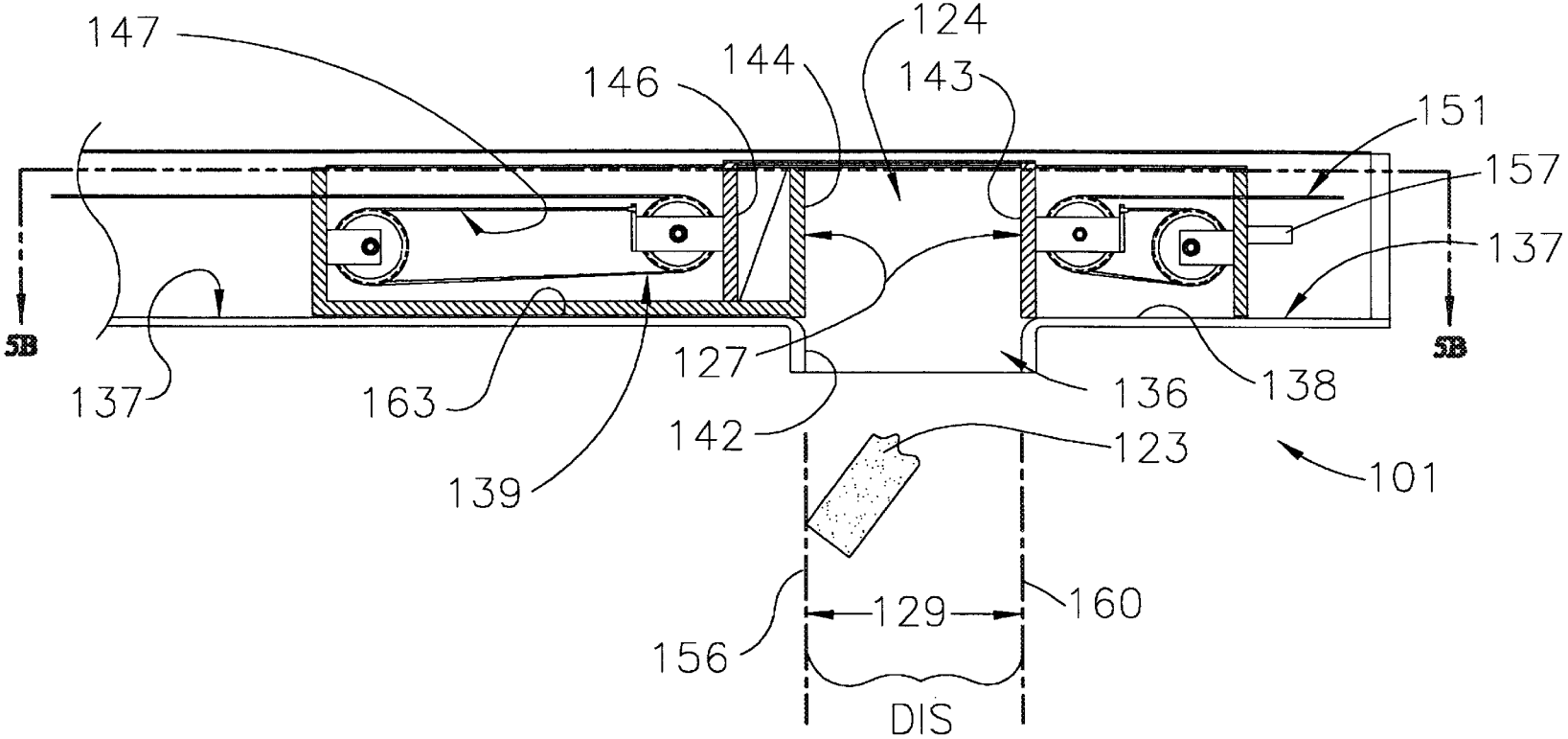
FIG. 5A is an elevational view of the embodiment of the present invention shown in FIGS. 1A, 2A, 3A, and 4A illustrating the first and second jaws of opposed vise members after movement together to a discharge station, wherein the jaws are shown in a fully open position and the loaf of dry waste is shown being discharged through the floor of the trough.
Figure 5B:
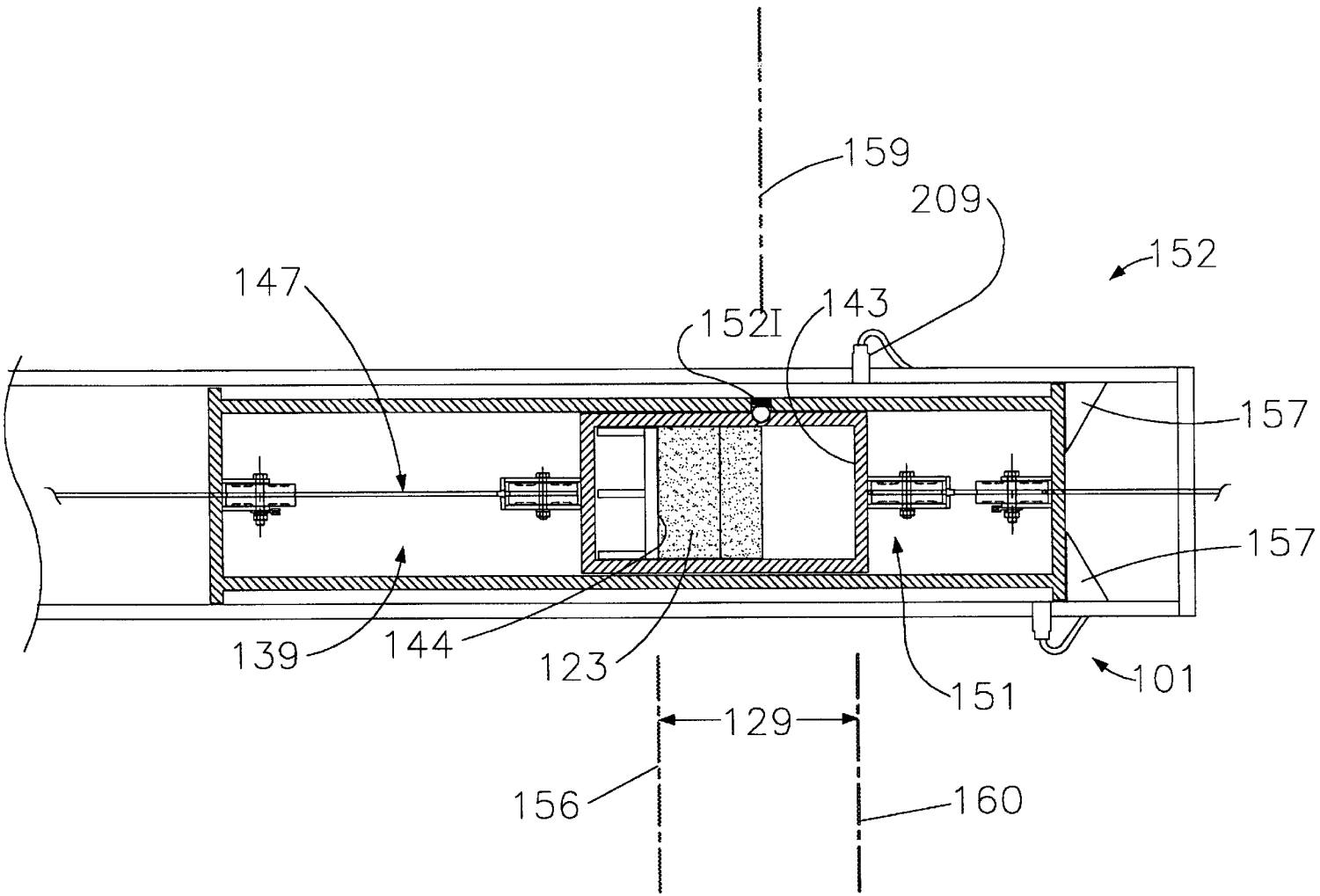
FIG. 5B is a plan view taken along line 5B—5B in FIG. 5A showing the open jaws and a right one of the force multipliers having pulleys close together after completing the movement to the discharge station.

In other aspects of this embodiment, FIGS. 4A and 4B show the loaf 123 of dry waste in the form of one separate loaf 123. FIGS. 5A and 5B show the loaf 123 after it has been conveyed for discharge from the drier 101. The platform 137 has an opening 142 in the surface 138, and the opening 142 defines the open bottom 136. The driver 139 is connected to the vise members 126 for moving the vise members 126 relative to the platform 137 to align the squeezer faces 127 with the opening 142. As shown in FIG. 5A, such alignment permits the one separate loaf 123 to be discharged from the vise 124 through the open vise bottom 136 (i.e., through the opening 142 in the trough 137).

Figure 2A:
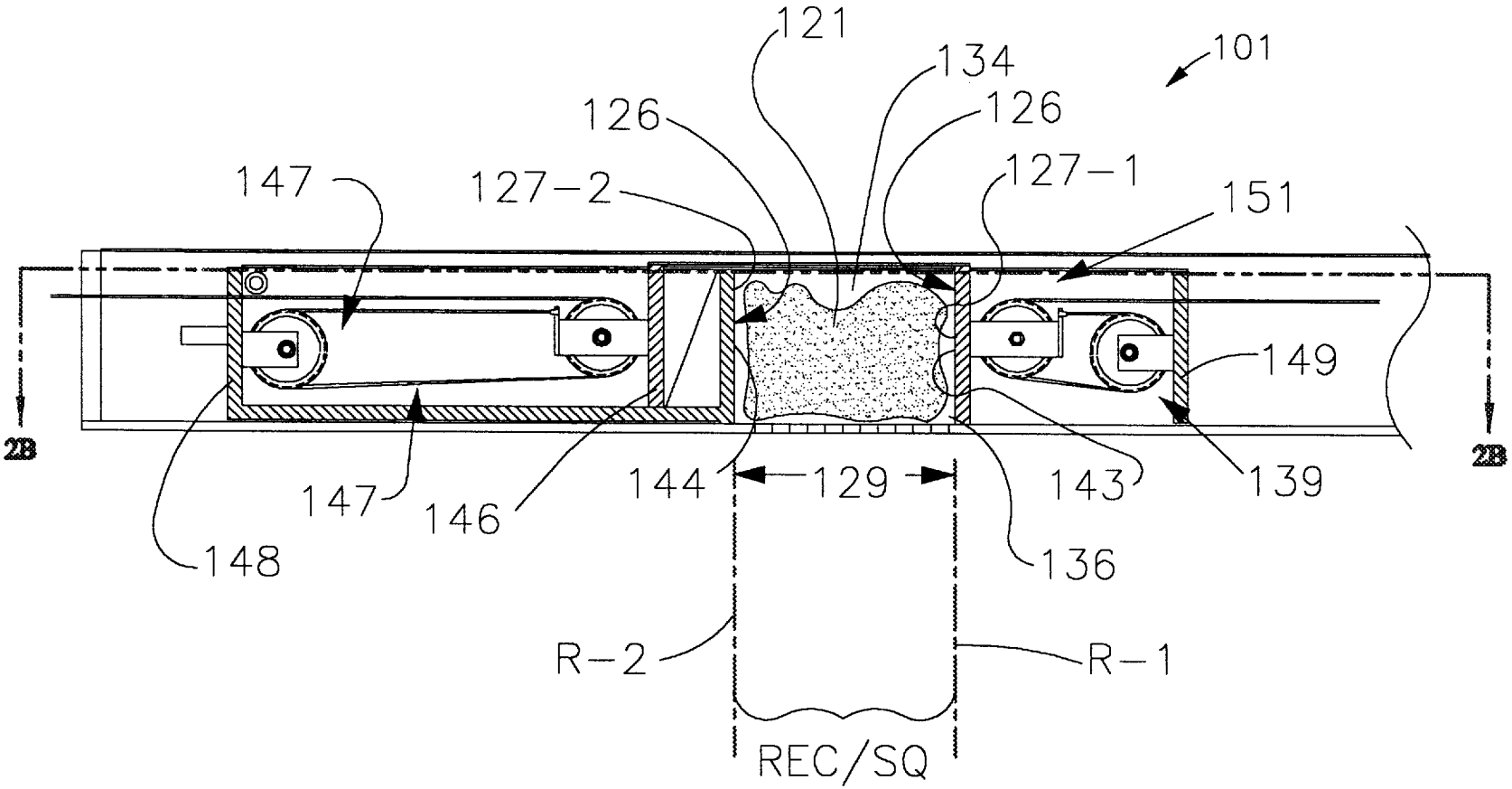
FIG. 2A is an elevational view of the embodiment of the present invention shown in FIGS. 1A and 1B, illustrating the wet loose screenings filling a volume defined by the first and second jaws in the open position.
Figure 3A:
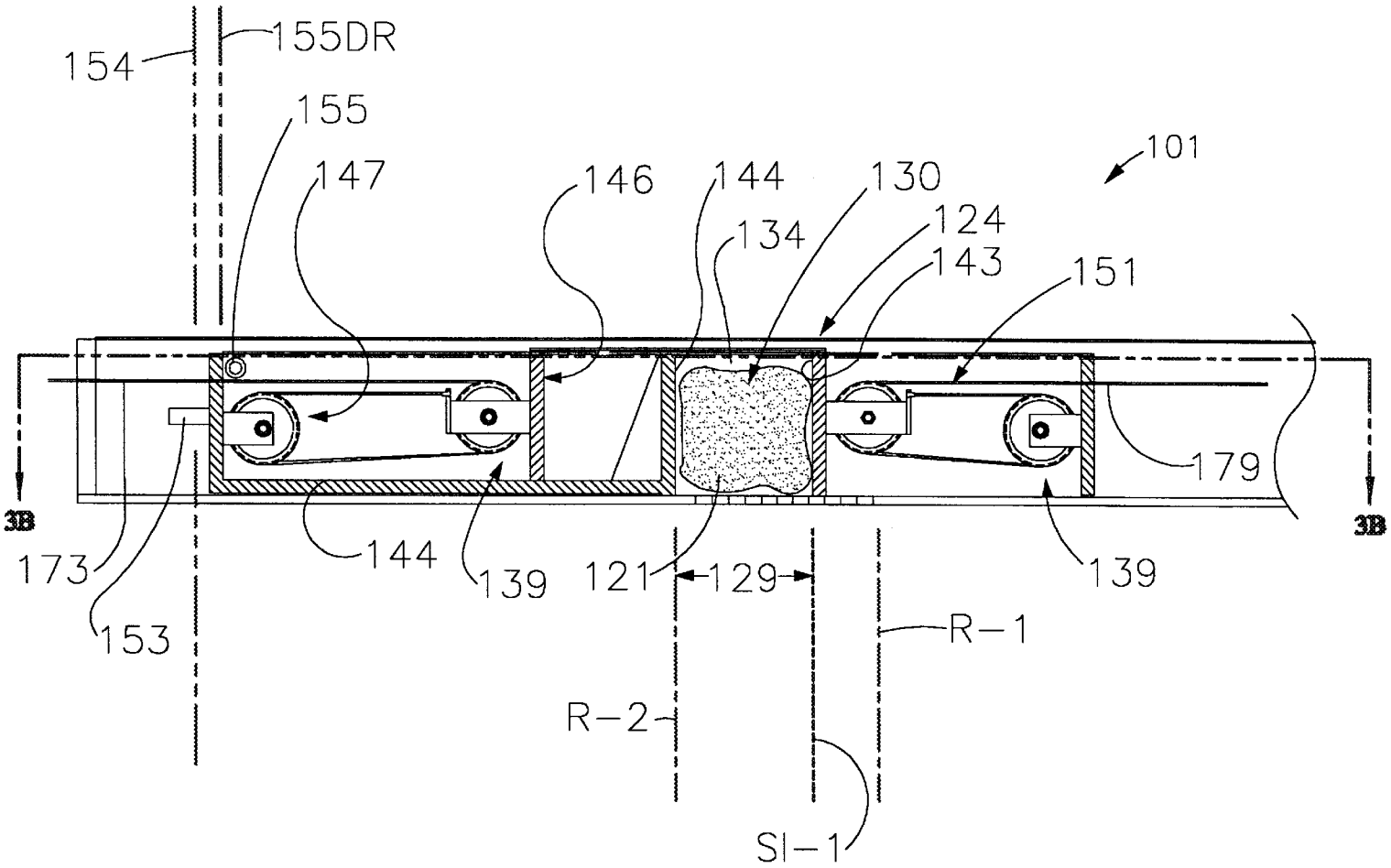
FIG. 3A is an elevational view of the embodiment of the present invention shown in FIGS. 1A and 2A, illustrating the first and second jaws of opposed vise members in a partially closed position squeezing the wet loose screenings, with the screenings resting on a sieve-like floor of the trough.

FIGS. 2A and 3A show more detail of the vises 124 of this embodiment. The vise members 126 may include a first of the squeezer faces 127 in the form of a first jaw 143 and a second of the squeezer faces 127 in the form of second jaw 144. FIGS. 2A, 3A, and 4A show the second jaw 144 carrying a left drive end 146 of the first jaw 143 for movement relative to the second jaw 144. The driver 139 includes a left drive 147 connected to a left drive end 148 of the second jaw 144 and to the left drive end 146 of the first jaw 143. On the right, FIG. 2A shows the squeezer face 127-1 of the first jaw 143 and a right drive end 149 of the second jaw 144 both supported by the trough 137 and connected to a right drive 151 of the driver 139.

Figure 1B:
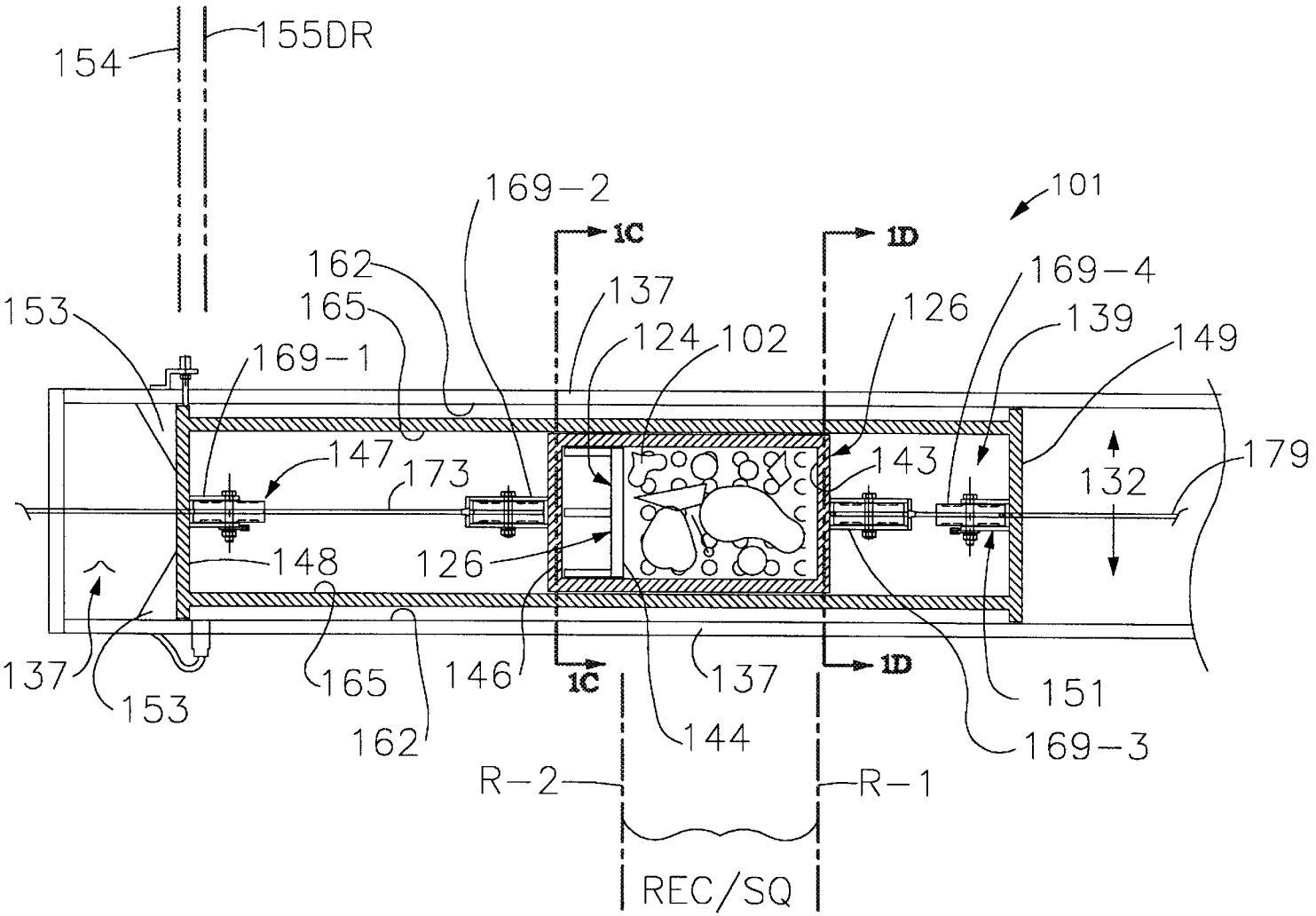
FIG. 1B is a plan view taken along line 1B—1B in FIG. 1A showing a trough for guiding the jaws for movement among various stations, and force multiplier drives for moving the jaws relative to each other and to the trough.
Figure 1D:
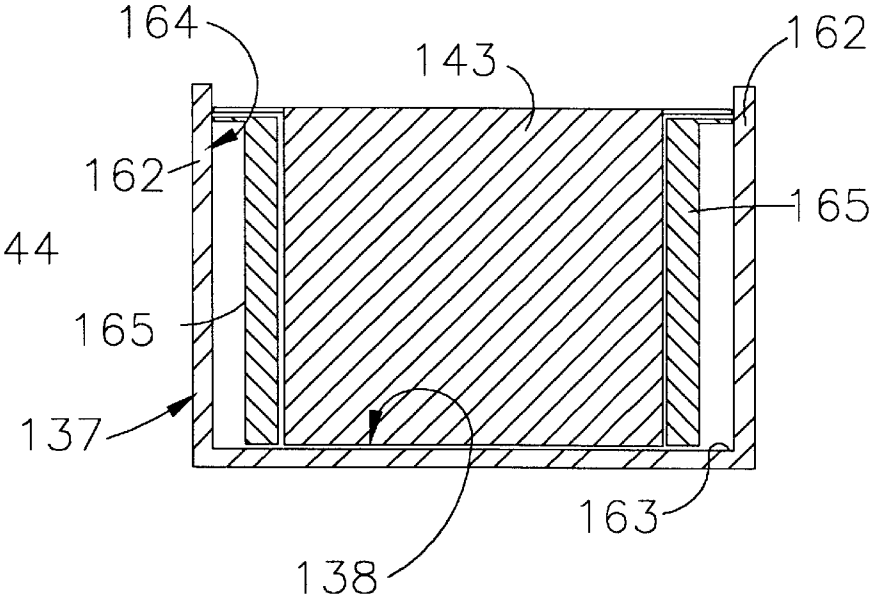
FIGS. 1C and 1D are end elevational views taken respectively along lines 1C—1C and 1D—1D in FIG. 1A showing the cross section of the trough, a portion of the first vise member supported by the second vise member, and the second vise member supported by the trough.
Figure 2B:
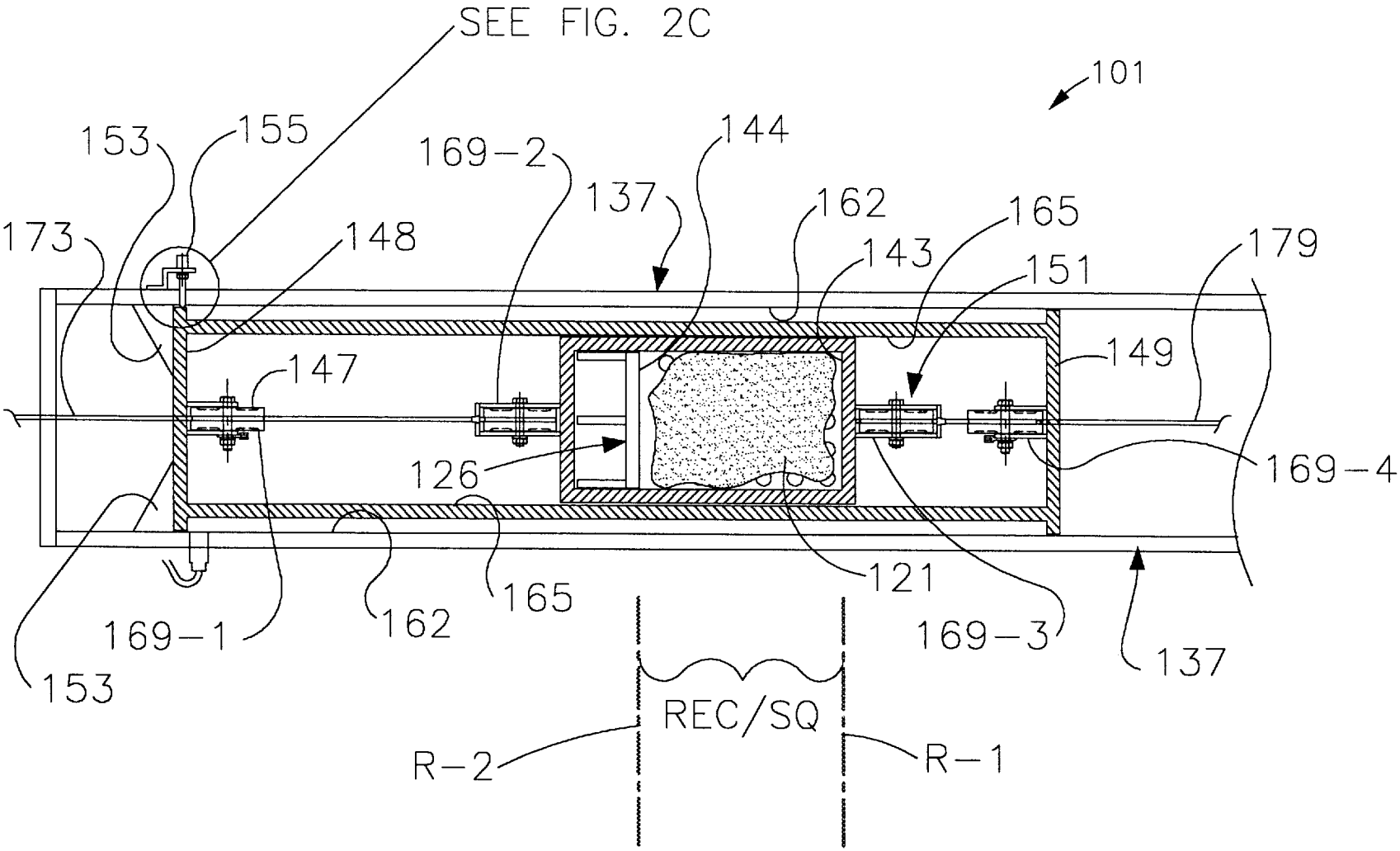
FIG. 2B is a plan view taken along line 2B—2B in FIG. 2A showing the jaws ready for movement relative to each other and the force multiplier drives positioned for moving the jaws relative to each other and to the trough to initiate the squeezing without lost motion.
Figure 2C:
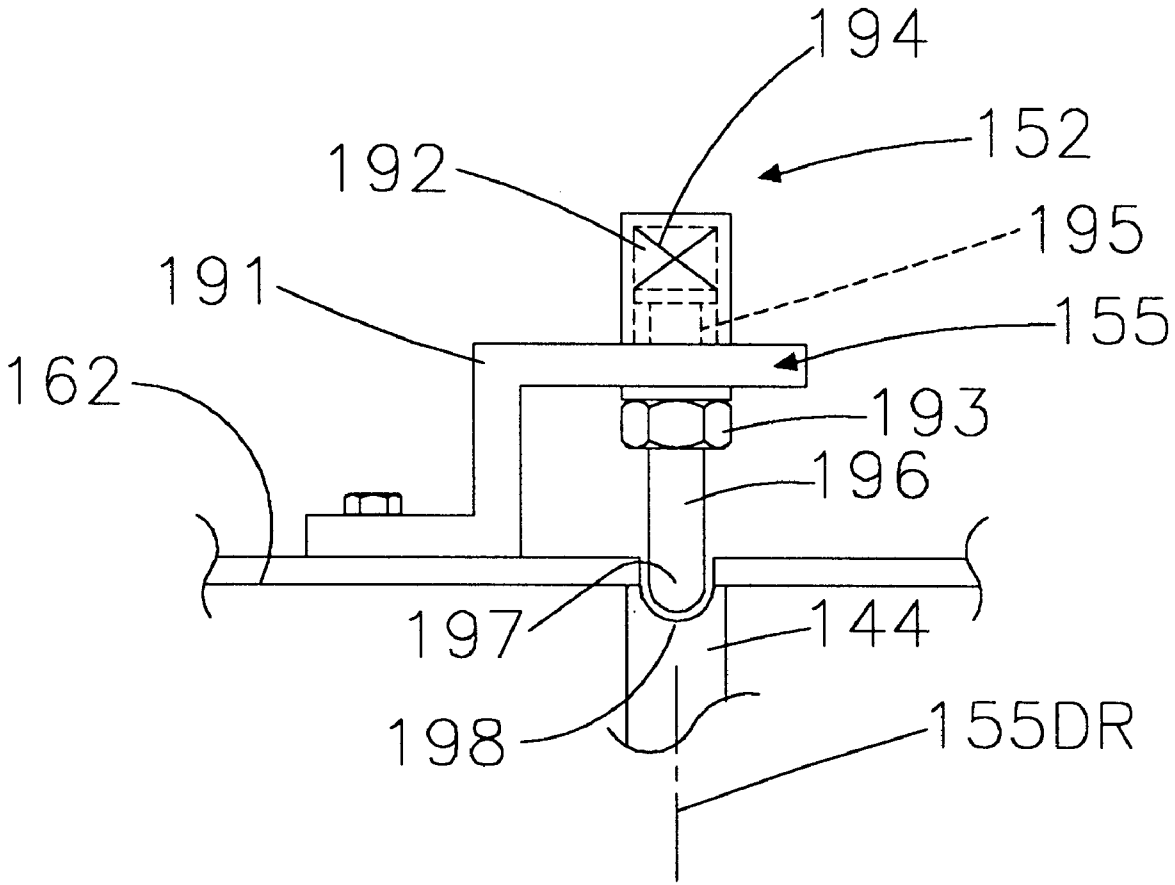
FIG. 2C is an enlarged view of a detent shown in FIG. 2B, illustrating a detent member secured to the trough and extending into a notch in the second vise member to retain the second vise member as the first vise member moves for squeezing.

Additionally, as shown in FIGS. 1A, 2C, and 5A the drier 101 may be provided with one or more stop devices 152 mounted on the platform 137. One of the stop devices 152 may, for example, be a pair of squeezer stops 153 (FIG. 1B) for limiting movement of the second jaw 144 (or the second vise member) relative to the platform 137. FIG. 1B shows that the squeezer stops 153 extend from the trough 137 into the leftward path of the second jaw 144 to prevent movement of the second jaw 144 leftward past the stops 153. With movement of the second jaw 144 limited by the squeezer stops 153, FIG. 3A shows the left drive 147 connected to the first jaw 143 for moving the first jaw 143 relative to the second jaw 144 (e.g., to the left in FIG. 3A).

Figure 13:
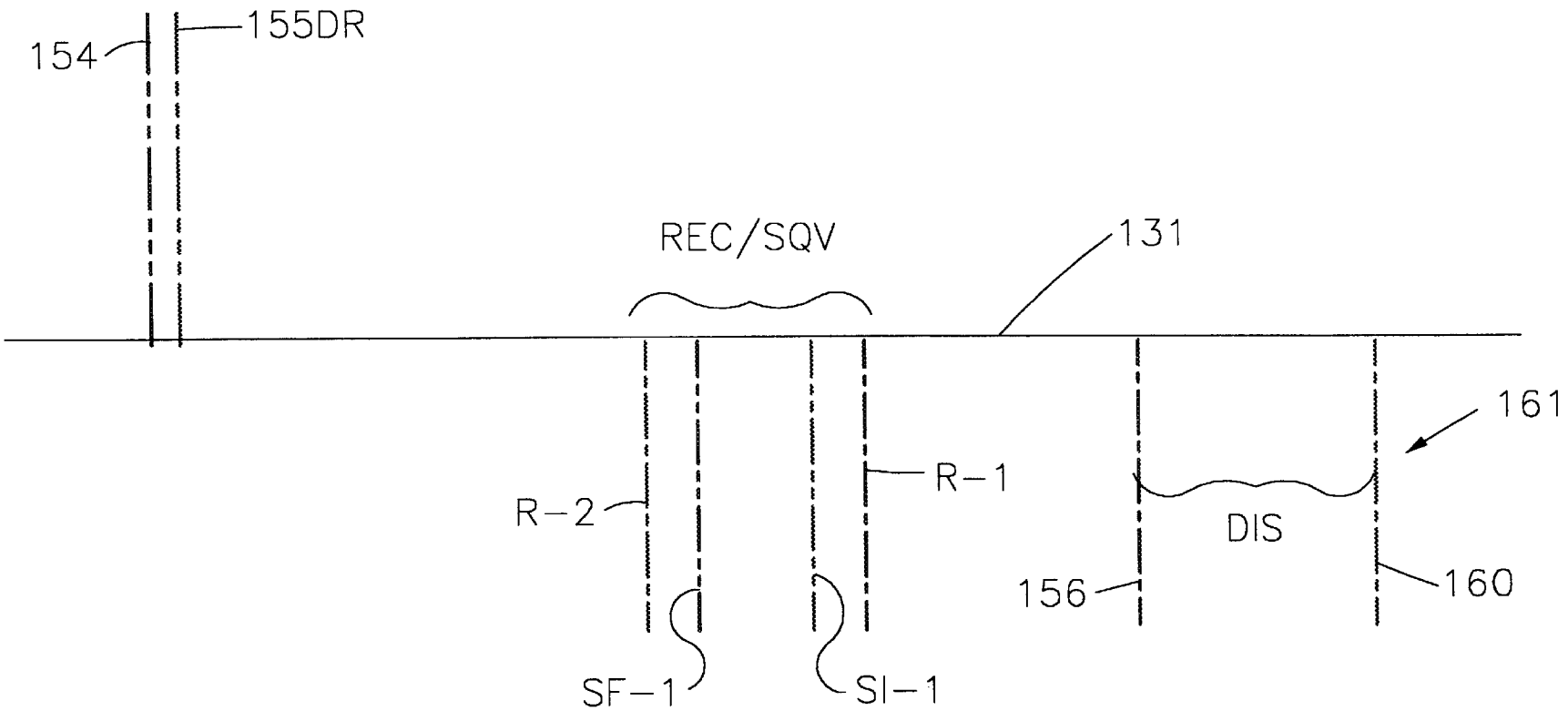
FIG. 13 is a diagram illustrating positions of the elements of the first embodiment of the drier of the present invention, and stations at which operations of the drier take place.

As shown in the various figures, vertical lines are used to indicate, for example, positions at which the stops 153 are located along the squeezer axis 131. Also, as shown in FIG. 13, for example, additional vertical lines 161 are illustrated to define positions, or stations, along the horizontal squeezing axis 131 at which the elements of the drier 101 may be positioned. For example, certain of the lines 161 designate "drier" stations at which the main functions of the drier 101 take place (e.g., receiving, squeezing, and discharge). Others of the lines 161 designate "jaw" stations at which the first jaw 143 and the second jaw 144 are positioned while the drier 101 performs such main functions.

The squeezer stops 153 may be mounted on the platform 137 at a first stop position identified by a vertical line 154. The moving of the first jaw 143 is effective to reduce the value of the length 129 of the initial vise volume 128. For example, the large jaw-open value of length 129 in FIG. 2A is reduced to the smaller jaw-squeezing value in FIG. 3A.

Figure 3B:
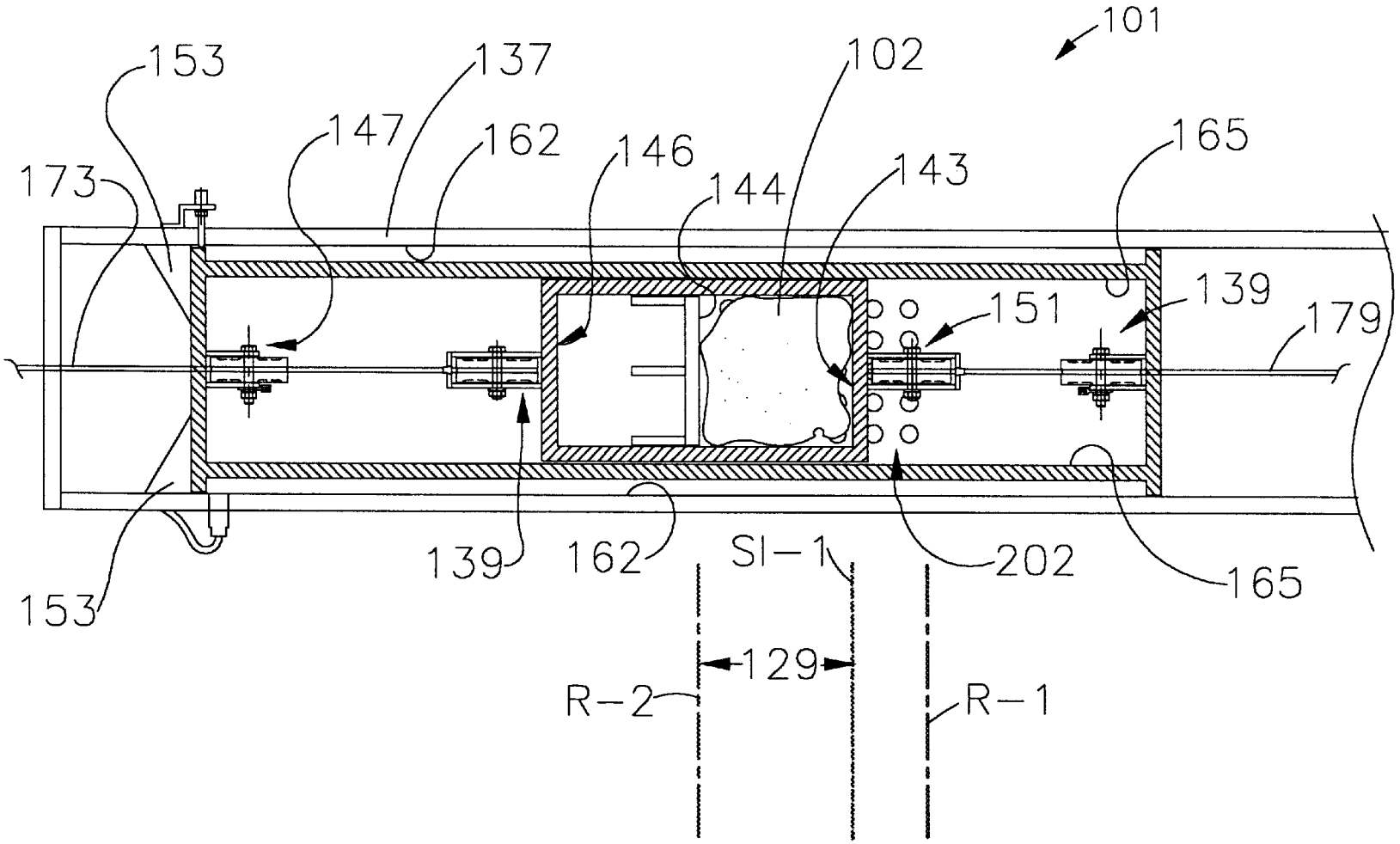
FIG. 3B is a plan view taken along line 3B—3B in FIG. 3A showing the trough guiding the jaws for movement as the squeezing occurs under the action of the force multiplier which moves the jaws relative to each other and to the trough.

FIGS. 3A and 3B show that another stop device 152 may, for example, be a releasable detent type stop device, such as a first, or receiver, detent 155 mounted on the platform 137 at a first detent position identified by a vertical line 155DR. In this case, as shown in FIGS. 1A, 2B, 6A and 6B, when the left drive 147 moves the second jaw 144 leftward against the stop 153, the first detent 155 engages the second jaw 144 to releasably hold tile second jaw 144 to the platform 137. Following a squeezing stroke in which the loose wet screenings 102 are formed into the loaf 123 (FIG. 4A), there is a return stroke during which the right drive 151 may move only the first jaw 143 to the right (as seen in FIG. 4A) toward the position shown in FIG. 2B. During the return stroke, and as the jaws 143 and 144 reach the position shown in FIG. 2B, the rightward force of the right drive 151 overcomes the releasable holding force of the first detent 155, such that the first jaw 143 and the second jaw 144 move rightward together and with the loaf 123.

In one aspect of the squeezing, after the left drive 147 moves the end 148 of the second jaw 144 leftward against the stop 153 and the first jaw 143 has moved through one squeezing stroke to the left to reduce the value of the length 129 of the initial vise volume 128 (to the smaller jaw-squeezing value shown in FIG. 3A), the squeezing may be considered complete. However, in another aspect of the squeezing, many such squeezing strokes may be made. In this instance, after the first of such squeezing strokes, the return stroke starts by the right drive 151 moving the first jaw 143 rightward toward but not to the jaw station R-1. The right drive 151 then stops and the left drive 147 moves the first jaw 143 leftward against the screenings 102, and to the fully-squeezed position shown in FIGS. 4A and 4B. This series of squeezing strokes and return strokes may be repeated as many times as is necessary.

When the squeezing has been completed, the rightward return stroke from the position shown in FIG. 4A continues until the second jaw 144 reaches a second jaw discharge station (indicated by a vertical line 156 shown in FIGS. 5A and 5B) at which position the second jaw 144 hits a second pair of the stops 152, identified as the discharge stops 157. The right drive 151 continues to move the first jaw 143 (e.g., to the right) away from the second jaw 144 to a first jaw discharge station indicated by the vertical line 160. Such continued movement increases the value of the length 129 of the vise volume 128 to the value shown in FIGS. 5A and 5B. The first jaw 143 thereby allows the loaf 123 to move (e.g., drop or fall) through the open bottom 136 and from between the vise (or squeezer) faces 127 to discharge the loaf 123 from the drier 101. The right drive 151 stops.

An inter-jaw detent 152I may be provided at a position 159 between the first jaw 143 and the second jaw 144 to keep those jaws in the open position during the return to the receiving station REC/SQU. The detent 152I is the same as the detent 358 described below with respect to FIG. 16. After the right drive 151 stops, the left drive 147 then moves the first jaw 143 and the second jaw 144 in the open position leftward until the second jaw 144 hits the stop 153 at position 154 (FIG. 1A). Then, the detent 155 releasably engages the second jaw 144. The inter-jaw detent 152I holds the two jaws 143 and 144 so that the relative positioning of the jaws is the jaw-open position shown in FIGS. 6A and 6B (ready to receive a batch 121 of the loose wet screenings 102), and the drive 147 stops to allow the jaws to receive the batch 121. At the start of the squeezing stroke, the releasable holding force of the inter-jaw detent 152I is overcome, such that the first jaw 143 is permitted to move toward the second jaw 144 to achieve the squeezing.

As shown in FIGS. 1A–6B, and in FIG. 13, the first embodiment of the present invention may provide the drier 101 for both forming and conveying the loaf 123 of dry compacted screenings 102. The loose wet screenings 102 are squeezed to define the loaf 123 of dry compacted screenings in the form of a three dimensional dry mass, and the loaf 123 is then conveyed for discharge from the drier 101. For the function of conveying the loaf 123, the vise 124 is provided with the first jaw 143 and the second jaw 144, each of the jaws 143 and 144 having the squeezer face 127 (or vise face), and the vise faces 127 are opposed to each other. FIG. 1C shows the trough 137 with the surface 138 defining vertical tracks 162 and a horizontal track 163. The tracks 162 and 163 form a guide or trackway (or floor) 164 extending horizontally from a first drier station (e.g., in FIGS. 1A and 1B identified by "REC/SQU", designating receiving and squeezing) to a second drier station (e.g., in FIGS. 5A and 5B identified by "DIS", designating discharge). FIG. 1C also shows the first jaw 143 received in and resting on the second jaw 144, which has a U-shaped cross section defined by walls 165 and a bottom 166. FIG. 1D shows the walls 165 without the bottom 166, such that the first jaw 143 rests on and is supported by the horizontal track 163 defined by the surface 138.

At the first drier station REC/SQU the screenings 102 are received between the first jaw 143 and the second jaw 144 in the loose wet form, with the first jaw 143 at a jaw station R-1 (designating the first jaw 143 at a screenings-receiving position) and the second jaw 144 at a jaw station R-2

(designating the second jaw 144 at the screenings-receiving position). To facilitate squeezing the wet loose screenings 102, the left drive end 146 (FIG. 1B) of the first jaw 143 may move relative to the second jaw 144, and the squeezer face 127-1 (FIG. 1A) of the first jaw 143 may move relative to the horizontal track 163 of the trough 137. FIGS. 3A and 3B show that for squeezing the loose wet screenings 102, the left drive 147 moves the first jaw 143 past an intermediate jaw station SI-1 (designating the first jaw 143 at the intermediate jaw station SI-1) to a jaw station SF-1 shown in FIG. 4A (designating the first jaw 143 at a full squeezing position), while the second jaw 144 is held at the jaw station R-2. FIGS. 5A and 5B show that for conveying, both jaws 143 and 144 are moved from the respective jaw stations SF-1 and R-2 to the respective jaw stations 160 and 156 which define the second, or discharge, drier station DIS of the drier 101. At the second drier station DIS the dry separate loaf 123 moves from the drier 101.

To facilitate conveying the loaf to the second drier station DIS, the left drive end 146 of the first jaw 143 is carried by the second jaw 144, arms 165A of the first jaw 143 extend over and are supported on the walls 165 of the second jaw 144, and the second jaw 144 is supported by the horizontal track 163 of the trough 137. Also, under the action of the right drive 151, the first jaw 143 is movable with the second jaw 144 relative to the trough 137 from the respective jaw stations SF-1 and R-1 shown in FIGS. 4A and 4B, to the respective jaw stations 160 and 156 shown in FIG. 5A.

Figure 1C:
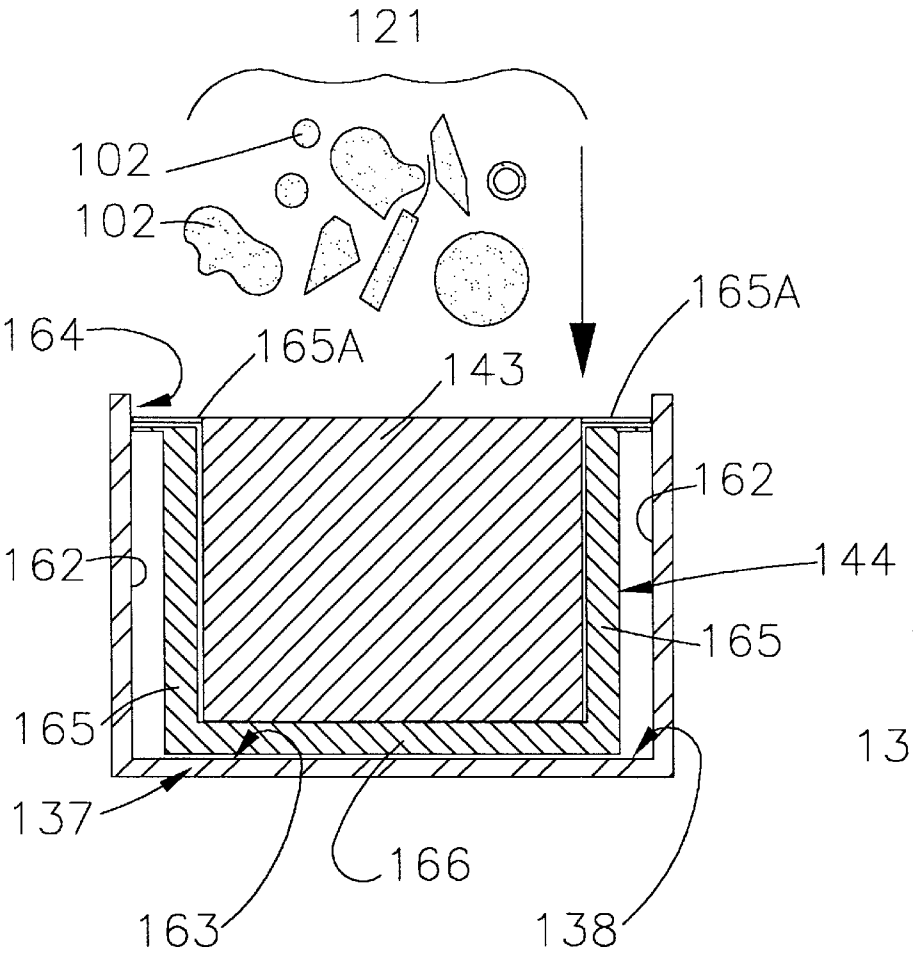
Figure 15:
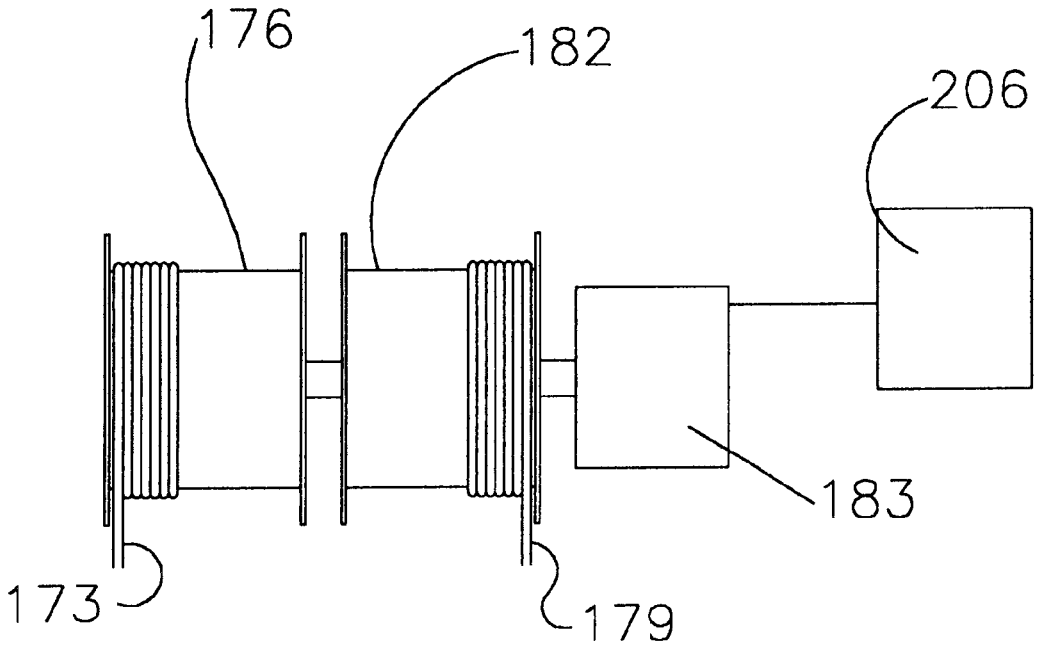
FIG. 15 is a schematic diagram of a motor for rotating two reels of a drive for paying out and taking up cables to move the jaws.

In this squeezing and conveying embodiment, the driver 139 may include the two (e.g., the left and right) respective drives 147 and 151. Generally, the drives 147 and 151 are connected between the first jaw 143 and the second jaw 144 for moving the first jaw 143 and the second jaw 144 together (i.e., at the same time) and relative to the first drier station REC/SQU and to the second drier station DIS. As described above, the driver 139 includes the left drive 147 connected to the left drive end 148 of the second jaw 144 and to the left drive end 146 of the first jaw 143. On the right, FIG. 2A shows the squeezer face 127-1 of the first jaw 143 and the right drive end 149 of the second jaw 144 both extending downward to the trough 137 from the arms 165A. The end 149 is connected to the right drive 151 of the driver 139. FIGS. 1A–1C show each of the left drive 147 and the right drive 151 as including two force multiplier pulleys 169. FIG. 1A shows a bracket 171 connecting a right pulley 169-2 of the left drive 147 to the left drive end 148 of the second jaw 144. FIG. 1A also shows a bracket 172 connecting the left pulley 169-1 of the left drive 147 to the left drive end 148 of the second jaw 144. A left cable 173 is shown in FIG. 2A having an end 174 secured to the bracket 171 and extending around these pulleys 169-1 and 169-2 of the left drive 147. FIG. 15 shows a left reel 176 which pays in and lets out the left cable 173.

On the right, FIG. 2A shows a bracket 177 connecting a left pulley 169-3 of the right drive 151 to the squeezer face 127-1 of the first jaw 143. FIG. 2A also shows a bracket 178 connecting the right pulley 169-4 of the right drive 151 to the right drive end 149 of the second jaw 144. A right cable 179 is shown in FIG. 2A having an end 181 secured to the bracket 177 and extending around these pulleys 169-3 and 169-4. FIG. 15 shows a right reel 182 which pays in and lets out the right cable 179.

The arrangement of the pulleys 169-1 and 169-2, and of the pulleys 169-3 and 169-4, is such that the forces applied by the respective cables 173 and 179 in the respective left and right directions as viewed in FIG. 1A are multiplied. For example, the pulleys 169-1 and 169-2 move in response to the leftward force from the left cable 173. Such movement is from the widely spaced relative position shown in FIGS. 2A and 2B to the more closely spaced relative position shown in FIGS. 4A and 4B. Also, the pulleys 169-3 and 169-4 move in response to the rightward force from the right cable 179. Such movement is from the widely spaced relative position shown in FIGS. 4A and 4B to the more closely spaced relative position shown in FIGS. 5A and 5B.

Figure 6A:
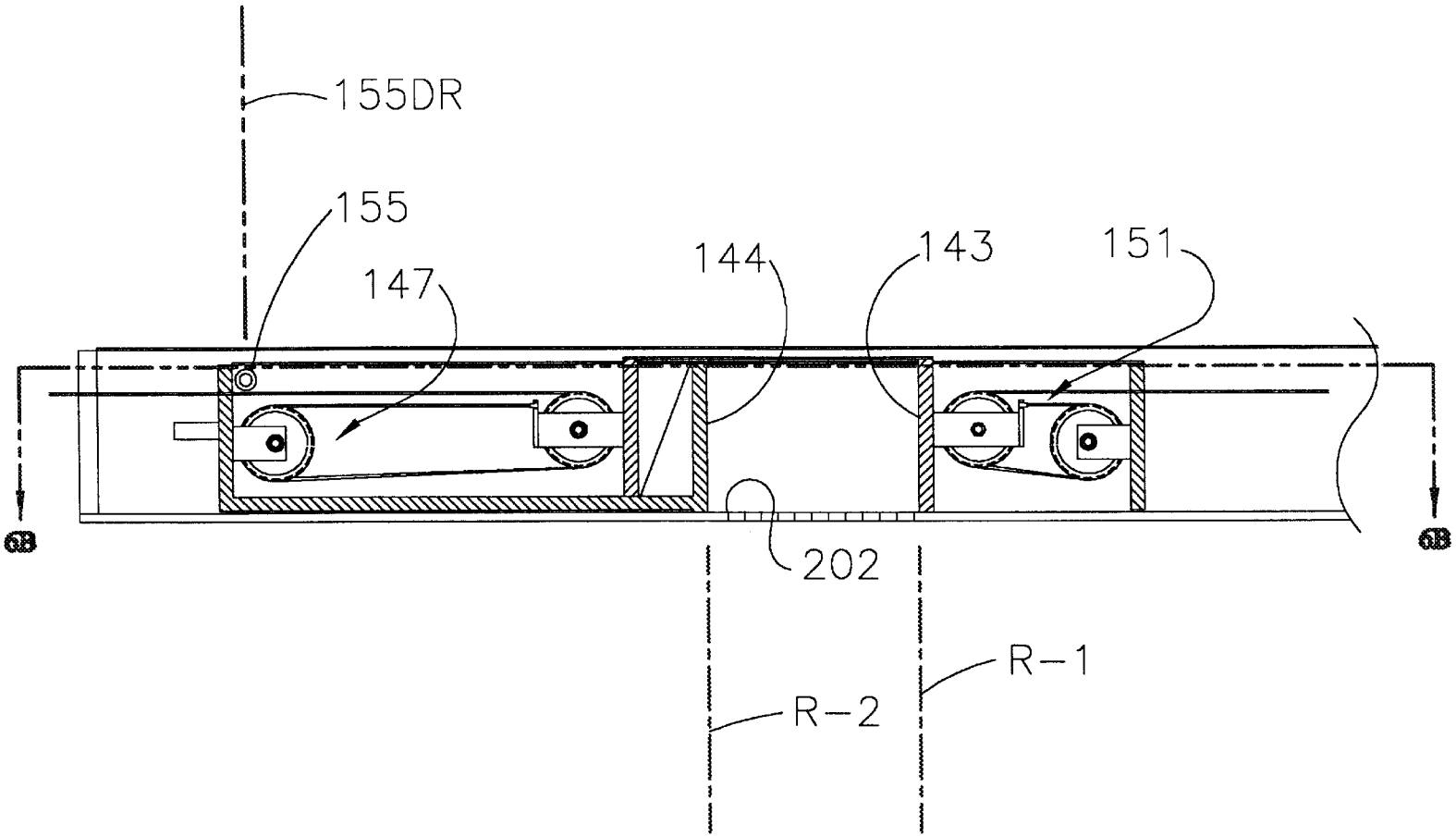
FIGS. 6A and 6B are views similar to respective FIGS. 1A and 1B showing first and second jaws returned to the receiving station and in a fully open position awaiting receipt of a next batch of wet loose screenings.
Figure 6B:
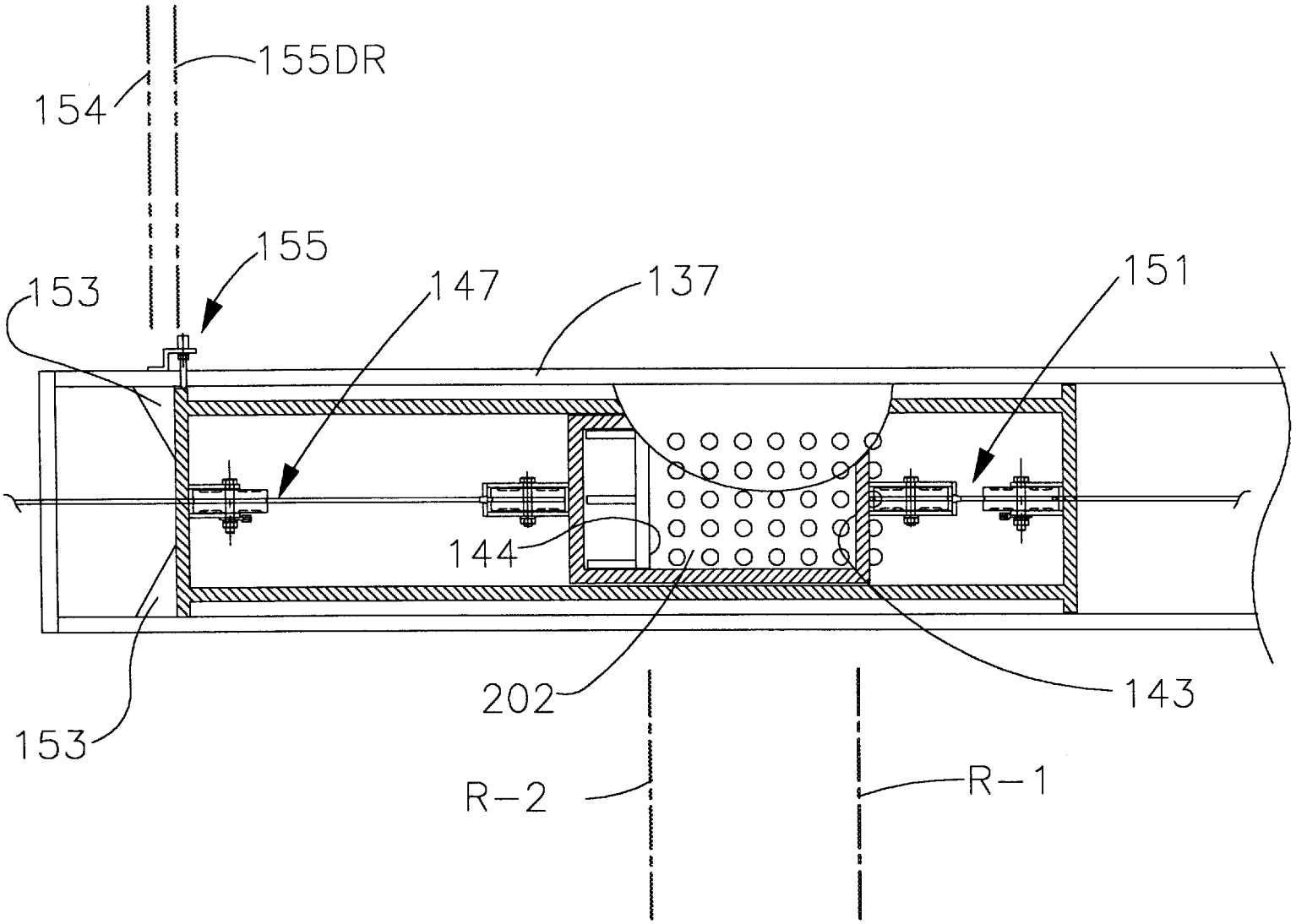

The left reel 176 and the right reel 182 may be as described in U.S. Pat. No. 5,655,727, issued on Aug. 12, 1998, for Sludge Collector Method and Drive With Shared Reel For Taking Up and Paying Out Cables, for example, which is incorporated herein by reference. In that case, as shown in FIG. 15, a common motor 183 rotates the left reel 176 and the right reel 182 at the same time and in the same direction. The left cable 173 and the right cable 179 are wound in opposite directions around the respective reels 176 and 182. In this manner, as the reels 176 and 182 are rotated in the same direction, one cable, such as the left cable 173, is taken up and the other cable, such as the right cable 179, is payed out. Such taking up of the left cable 173 moves the drier elements from the positions shown in FIGS. 2A and 2B to the positions shown in FIGS. 4A and 4B. The motor 183 then stops, and the direction of rotation reverses, so that the right cable 179 is taken up and the left cable 173 is payed out. Such taking up of the right cable 179 moves the drier elements from the positions shown in FIGS. 4A and 4B to the positions shown in FIGS. 5A and 5B, at which time the motor 183 stops, and the direction of rotation again reverses, so that the left cable 173 is again taken up and the right cable 179 is again payed out as described above until the jaws 143 and 144 are positioned as shown in FIGS. 6A and 6B at respective jaw stations R-1 and R-2.

FIG. 2C shows one of the stop devices 152 mounted on a bracket 191 secured to the vertical track 162 of the trough 137. This stop device 152 is the receiver detent 155 for releasably holding the second jaw 144 relative to the platform 137. The receiver detent 155 includes a housing 192 secured to the bracket 191 by a nut 193. The housing 192 is hollow and receives a biasing element such as a spring 194. The spring 194 urges a piston 195 outwardly of the housing 192 to urge a piston rod 196 toward the second jaw 144. A distal end 197 of the rod 196 is rounded for reception in a recess 198 provided in the left drive end 148 of the second jaw 144. The rounding of the distal end 197 and of the recess 198 are dimensioned so that the rod 196 remains in the recess 198 during the leftward movement of the first jaw 143 (as shown in FIG. 2B). Such leftward movement moves the first jaw 143 relative to the second jaw 144 to squeeze the loose wet screenings 102 and define the loaf 123 shown in FIG. 5A. The receiver detent 155 is mounted on the platform 137 at the first position 154.

The other stop device 152, the discharge stop 156, is mounted on the vertical track 162 of the platform 137 at the position 159 and has the same structure as the squeezer stop 153. To avoid duplicate description, it may be understood that the foregoing description of the squeezer stop 157 is applicable to the discharge stop 156, except as noted below. As shown in FIGS. 5A and 5B, with the discharge stop 157 preventing rightward movement of the second jaw 144, the right drive 151 moves the first jaw 143 away from (e.g., to the right) the second jaw 144 to increase the value of the length 129 of the vise volume 128 and allow the loaf 123 to move (e.g., drop or fall) through the open bottom 136 and from between the squeezer faces 127 to discharge the loaf 123 from the drier 101.

In the case of the detent 155, a certain force will overcome the force of the spring 194 which acts on the rod 196. For example, as shown in FIG. 4A, via the above-described force multiplication the right cable 179 pulling to the right on the right drive 151 will provide enough force in the direction of the squeeze axis 131 to overcome the spring force and allow the second jaw 144 to move to the right with the first jaw 143 from the first drier station REC/SQU to the discharge drier station DIS. When the second jaw 144 reaches the second drier station DIS and hits the stop 157, the first jaw is at the first jaw discharge station 160 and the distal end 197 of the rod 196 of the discharge stop 156 engages the recess 198. The first jaw 143 continues moving to the right to jaw station 160. With the first jaw 143 at the jaw station 160 and the second jaw 144 at the jaw station 156, the jaws 143 and 144 are open to allow the loaf 123 to drop through the opening 142 and out of the drier 101.

It may be understood that in this squeezing and conveying embodiment, the squeezer faces 127 may also be spaced and each have the width 132 and height 133, so that between the squeezer faces 127 the initial vise volume 128 (i.e., a screenings-receiving volume) is defined once the length 129 of the spacing between the squeezer faces 127 is defined. This screenings-receiving volume 128 is reduced in value upon movement of the first jaw 143 relative to the second jaw 144, which reduces the length 129 and defines a squeezed (or dry) volume 141. The squeezed volume 141 is defined by the width 132, the height 133 and the length 129. Each of the screenings-receiving volume 128 and the squeezed volume 141 have the open top 134 to permit the reception of the screenings 102 between the first jaw 143 and the second jaw 144. The floor 163 of the guide 164 beneath the first jaw 143 and the second jaw 144 maintains the screenings 102 between the first jaw 143 and the second jaw 144 so that the movement of the first jaw 143 relative to the second jaw 144 forms the loaf 123 from the loose and wet screenings 102. Further, the floor 163 is open at the second drier station DIS. The screenings-receiving volume 128 and the squeezed volume 141 of the vise 124 have the open bottom 136, such that when the loaf 123 is moved to the second drier station DIS the loaf 123 drops from between the first jaw 143 and the second jaw 144 and is discharged from the drier 101.

Another feature of this embodiment relates to the receipt by the drier 101 of the batches 121 of the loose wet screenings 102 from the screen 103. The rate of such receipt may vary over time. However, the rate at which a given batch 121 of loose wet screenings 102 is formed into the loaf 123 and conveyed to the second drier station DIS is independent of the rate at which the screen 103 supplies the screenings 102 to the drier. The driver 139 is connected between the first jaw 143 and the second jaw 144, and the timing of the operation of the motor 183 is controlled for moving the first jaw 143 and the second jaw 144 relative to the respective first and second drier stations REC/SQU and DIS so that the loaf 123 is defined and moved from the drier 101 before an additional batch 121 of screenings 102 is supplied from the screen 103.

Another embodiment of the present invention may provide the drier 101 for use with the screen 103 for removing the screenings 102 from the channel 104 through which the screenings 102 flow in the liquid 107. The screen 103 moves the screenings 102 in the loose wet condition out of the liquid 107 to a position above the channel 104. The vise 124 has the vise members 126. Each of the vise members 126 has one of the vise faces 127. In this embodiment, the vise faces 127 are mounted above and vertically aligned with the channel 104. Also, the platform (or trough) 137 is mounted between the drier 101 and the channel 104 and is vertically aligned with the channel 104. The platform 137 has the surface 138 in the form of the horizontal track, or floor, 163 for supporting the loose wet screenings 102 in the screenings-receiving volume 128 between the opposed squeezer faces 127 and for supporting the loaf 123. The platform 137 is also perforated at the drier station REC/SQU to define a sieve-like section 202 of the horizontal track 163 which permits the liquid 107 to flow out of the screenings-receiving volume 128 into the channel 104. In addition, the drive 139 moves the squeezer faces 127 relative to each other to reduce the size of the screenings-receiving volumes 128 and squeeze the loose screenings 102 so that the liquid 107 in the squeezed screenings 102 flows through the sieve-like section 202 directly into the channel 104 without flowing through a next batch 121 of the screenings 102 removed from the channel after the prior squeezed batch 121.

This embodiment may also operate with screenings 102 having undesirable material (not shown) thereon. In this case, a sprayer 203 (FIG. 14) is provided at the first drier station REC/SQU, for example, for directing clean liquid 204 onto the loose wet screenings 102 before the squeezing operation of the vise 124. In this manner, the undesirable material is removed from the screenings 102 and flows directly into the channel 104 without first flowing onto any loaf 123 of other previously squeezed screenings 102 that have been removed from the channel 104.

In another embodiment of the present invention, a controller 206 is provided for the driver 139. The controller 206 causes the driver 139 to move the first jaw 143 and the second jaw 144 toward each other at the first drier station REC/SQU to squeeze the loose wet screenings 102 and to define the loaf 123. The controller 206 causes the driver 139 to move the first jaw 143 and the second jaw 144 away from each other at the second drier station DIS to permit the loaf 123 to move from the drier 101. The controller 206 may, for example, be a DC input dual limit alarm sold by Wilkerson Instrument Co., Inc., of Lakeland, Fla. Such controller 206 responds to the current drawn by the motor 183 and reverses the direction of rotation of the motor 183 at a desired current. Alternatively, the controller 206 may be of the type that responds to one or more sensors 207 which detect an object at a certain position. In response to a sensor 207 detecting the object, the controller 206 stops the motor 183 and reverses the direction of rotation of the motor 183. A first sensor 208 (FIG. 4B) may, for example, be located at the jaw station S-1. The sensor 208 is activated by the positioning of the first jaw 143 at the jaw station SF-1, which is at the end of the desired path of movement of the first jaw 143 in a first direction, such as the left direction shown in FIG. 4B. The motor controller 206 may also be responsive to a second sensor 209 (FIG. 5B), which may, for example, be located at the jaw station 160. The sensor 209 is activated by the positioning of the first jaw 143 at the jaw station 160, which is at the end of the desired path of movement of the first jaw 143 in a second direction, such as the right direction shown in FIG. 5A.

A method of the present invention may be understood by reference to FIG. 17 which shows the steps of squeezing loose wet screenings 102 to define a single three dimensional loaf 123 of compressed dry screenings 102. The method includes a step 500 of dropping the loose wet screenings 102 into the opening 142 between the opposed vise (or squeezer) faces 127. Also, a step 501 provides support below the opening 142 (e.g., provides the horizontal track 163) to retain the loose wet screenings 102 in the open bottom 136 between the opposed vise faces 127. Another step 502 moves the vise faces 127 toward each other to squeeze the screenings 102 between the opposed vise faces 127.

An additional aspect of the method of the present invention is shown in FIG. 18. There, in a step 502A the vise face moving step 502 immediately starts to compress the screenings 102 upon initiation of the moving of the opposed vise faces 127. In FIG. 19, a step 502B may be provided for performing the moving step 502 a plurality of times, and in a step 502C the vise faces 127 may be moved away from each other before the next moving step 502B is performed.

Referring to FIG. 20, the method may also provide a step 510 for conveying the vise faces 127 and the loaf 123 to a discharge station (e.g., to the second drier station DIS) while the loaf 123 is supported by the support (track 163) and is between the vise faces 127. A step 511 provides the opening 142 in the support track 163 at the drier discharge station DIS to permit discharge of the loaf 123 from between the vise faces 127.

In another embodiment of the method of the present invention the screen 103 has a plurality of operating cycles. In each cycle, a batch 121 of screenings 102 is delivered to the drier 101. Referring to FIG. 21, the method includes a step 550, performed at the end of each operating cycle, of dropping the wet loose screenings 102 into the open top 134 between the opposed vise faces 127. Then, a step 551 provides the support track 163 below the open bottom 136 to retain the loose wet screenings 102 between the opposed vise faces 127. In a step 552, the screen cycles are coordinated with the operation of the vise faces 127. For example, after each cycle of the screen 103, the vise faces 127 are moved toward each other to squeeze and dry the screenings 102.

An additional aspect of the method of the present invention is shown in FIG. 22, and includes a step of conveying the loaf 123 of screenings 102 from a squeezing station (e.g., the first drier station REC/SQU) to a discharge station (e.g., the second drier station DIS). The method includes the step 575 of dropping the wet loose screenings 102 into the open top 134 between the opposed vise faces 127. By a step 576 of providing the support (e.g., the track 163) below the opposed vise faces 127, the loose wet screenings 102 are retained between the opposed vise faces 127. In a step 577, the vise faces 127 are moved toward each other, and the screenings 102 are squeezed and dried and the loaf 123 is defined. Also, a step 578 provides moving of the vise faces 127 and the loaf 123 as a single unit to the discharge station DIS. A step 579 then moves the vise faces 127 away from each other and the loaf 123 is released for discharge from the drier 101.

Drier 301

Figure 7A:
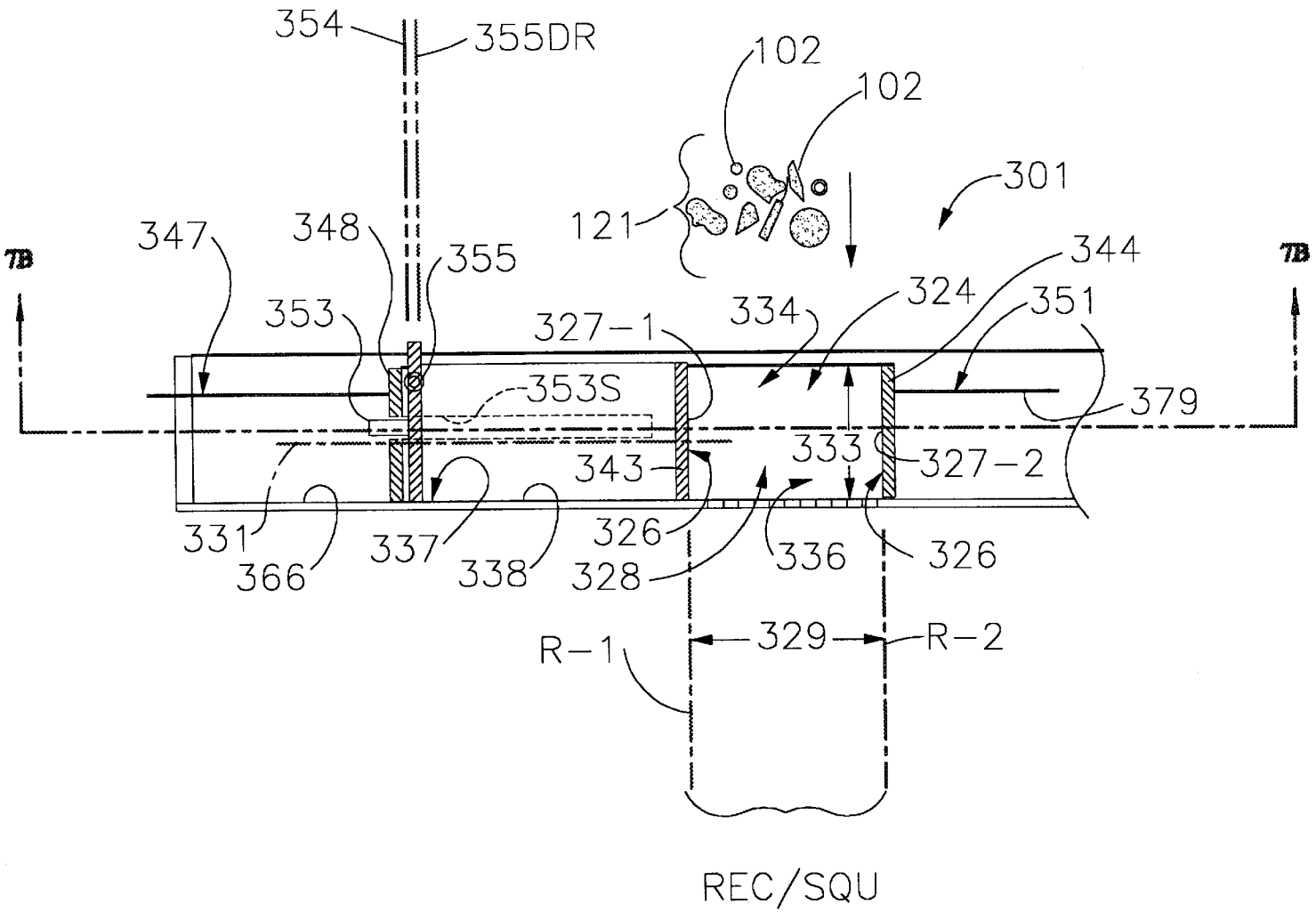
FIG. 7A is an elevational view of second embodiment of a drier of the present invention showing first and second jaws of opposed vise members in an open position at a receiving/squeezing station for receiving wet loose screenings.
Figure 7B:
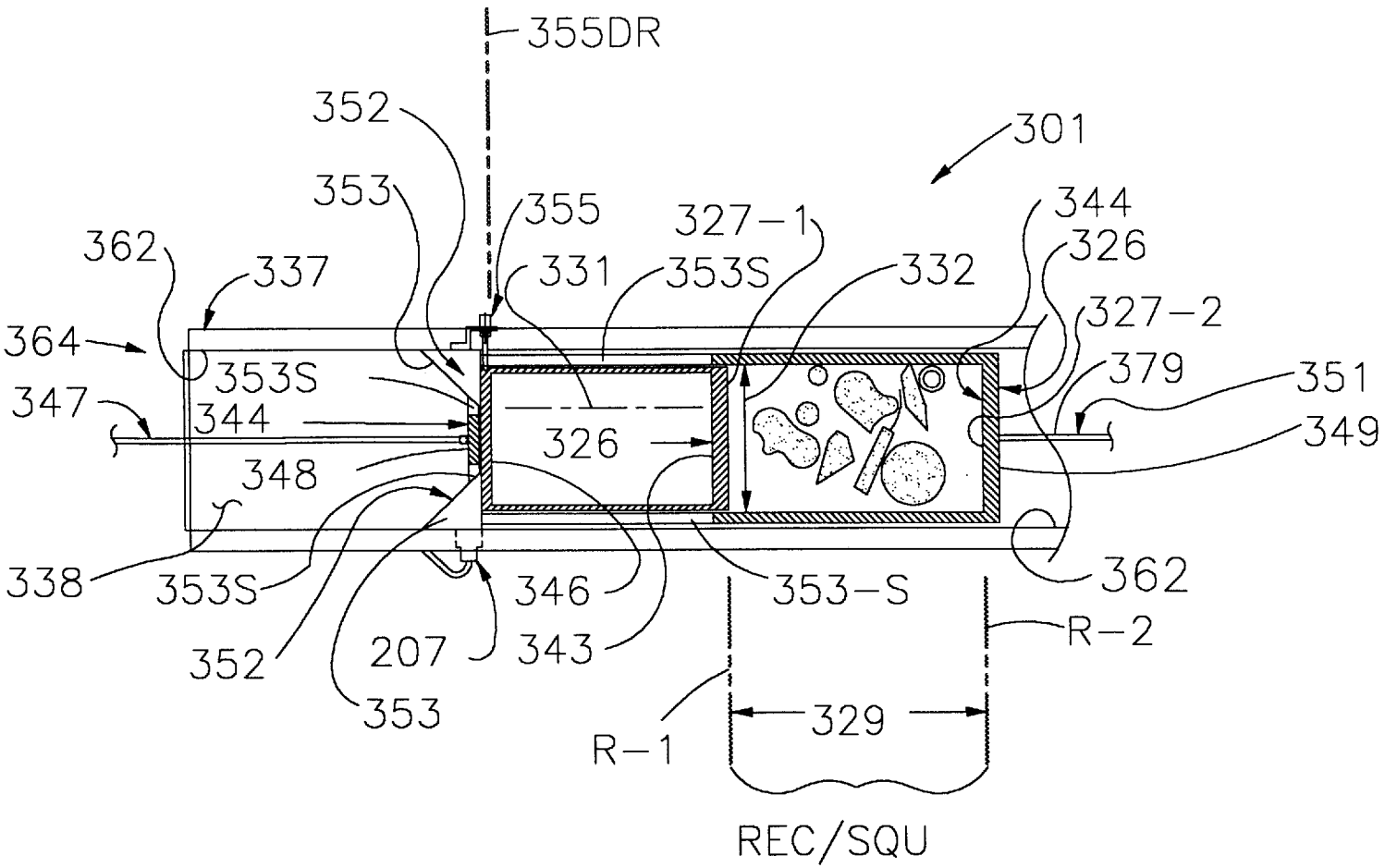
FIG. 7B is a plan view taken along line 7B—7B in FIG. 7A showing a trough for guiding the jaws for movement among various stations, and cables of a drive acting directly on a first of the jaws for moving the jaws relative to each other and to the trough.
Figure 8A:
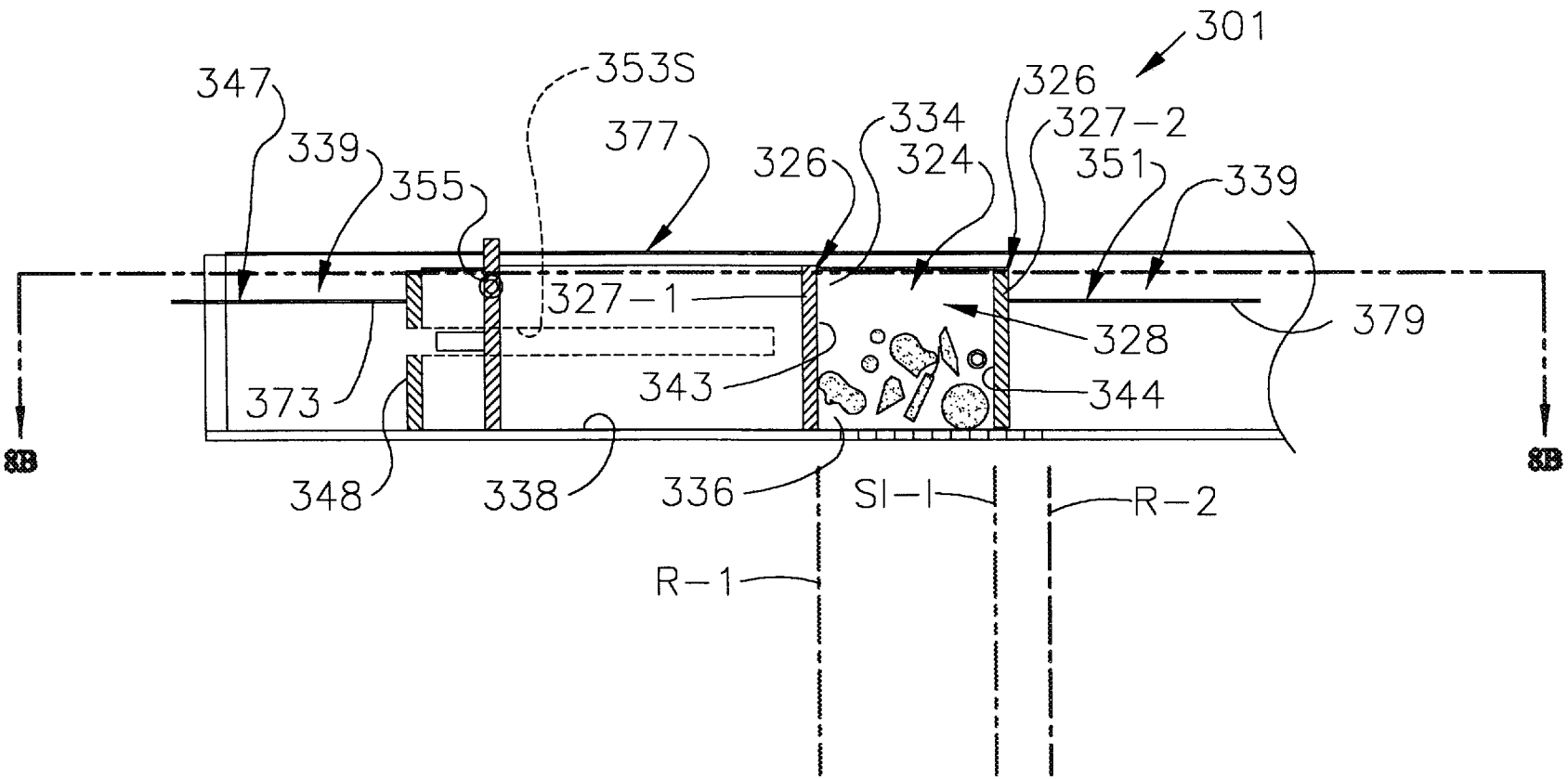
FIG. 8A is an elevational view of the second embodiment of the drier shown in FIGS. 1A and 1B, illustrating a left cable starting to pull the second jaw to the left to squeeze the loose wet screenings.
Figure 8B:
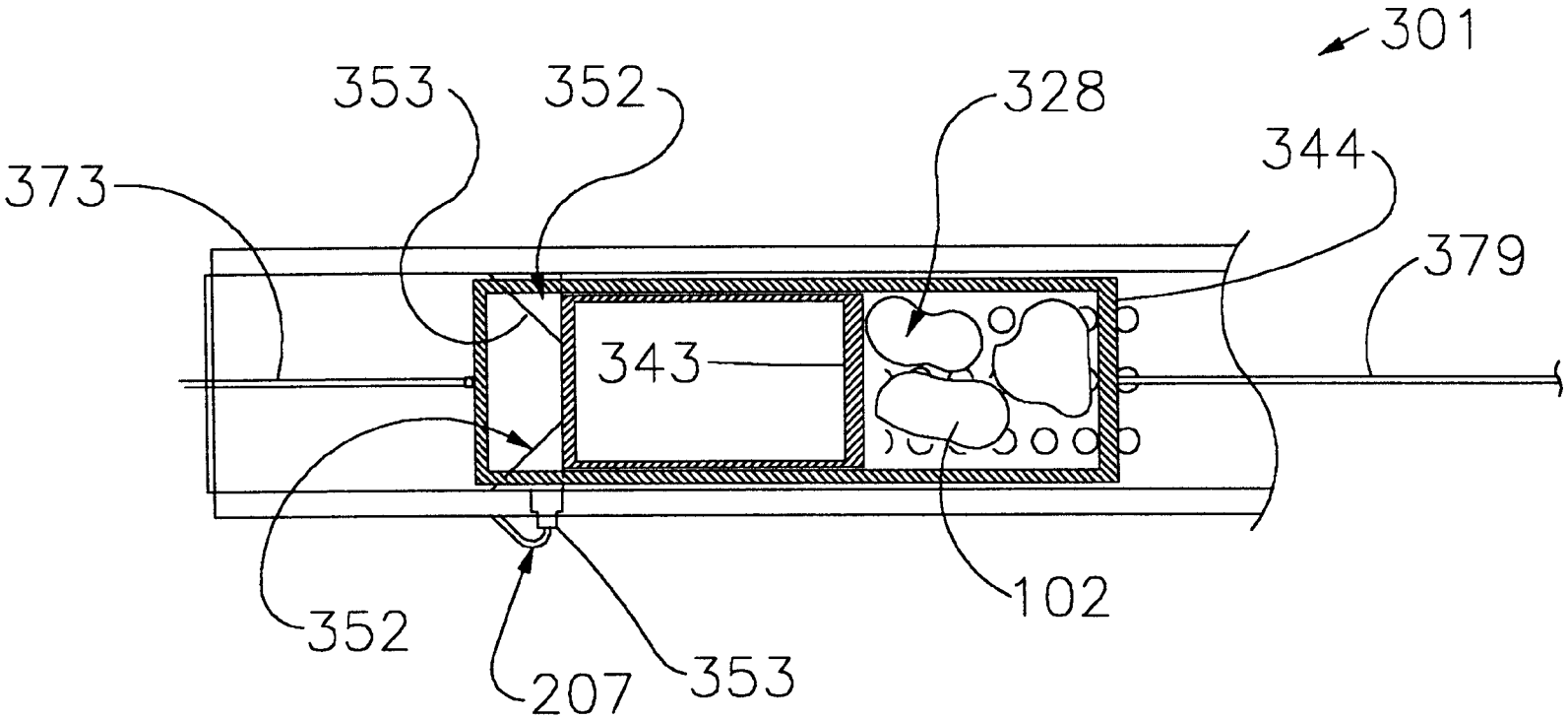
FIG. 8B is a plan view taken along line 8B—8B in FIG. 8A showing the first jaw held at the receiving/squeezing station by a stop as the second jaw moves to the left.
Figure 9:
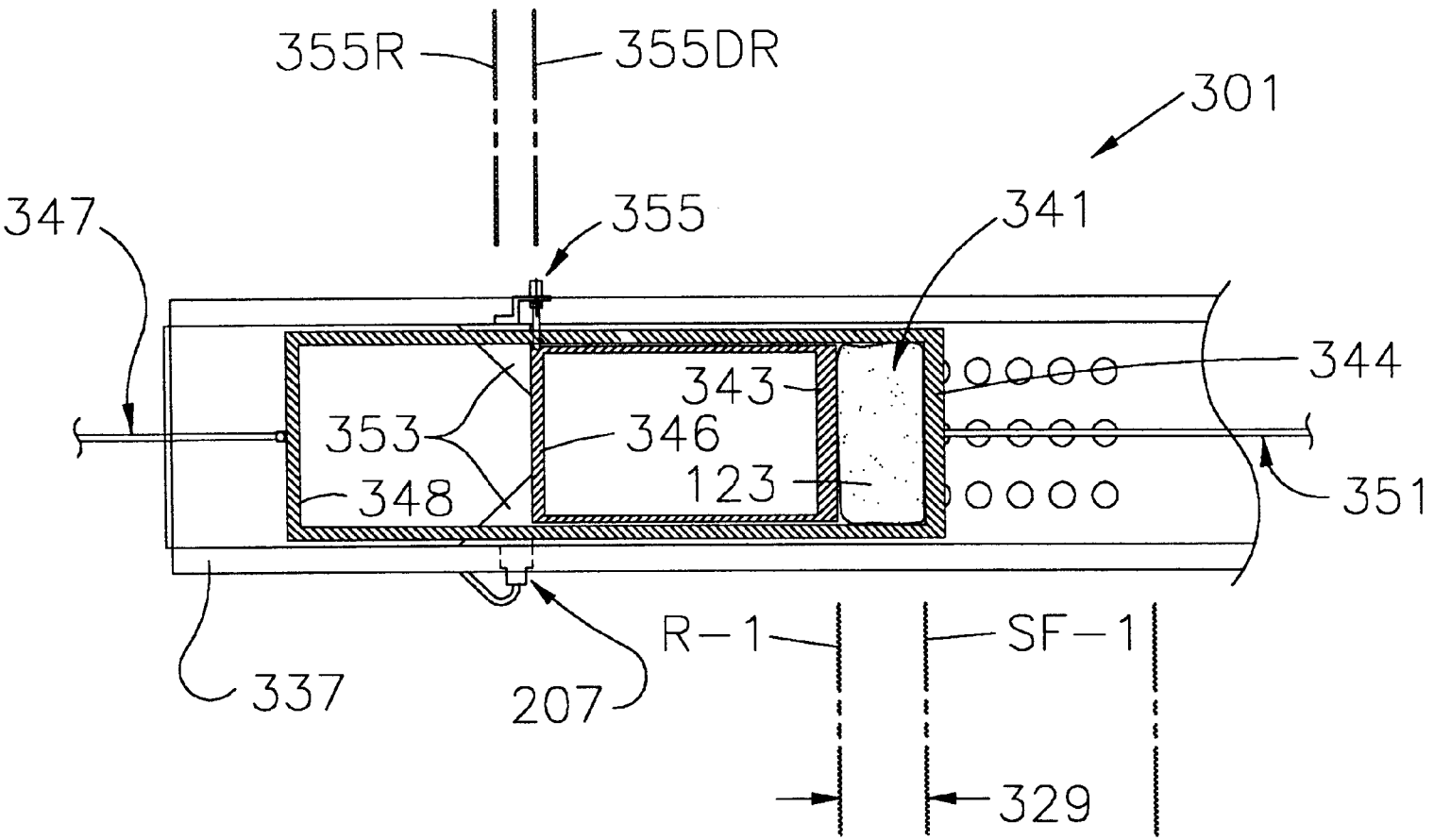
FIG. 9 is a plan view of the drier shown in FIGS. 7A–8B illustrating the jaws squeezing the screenings into a loaf.
Figure 10:
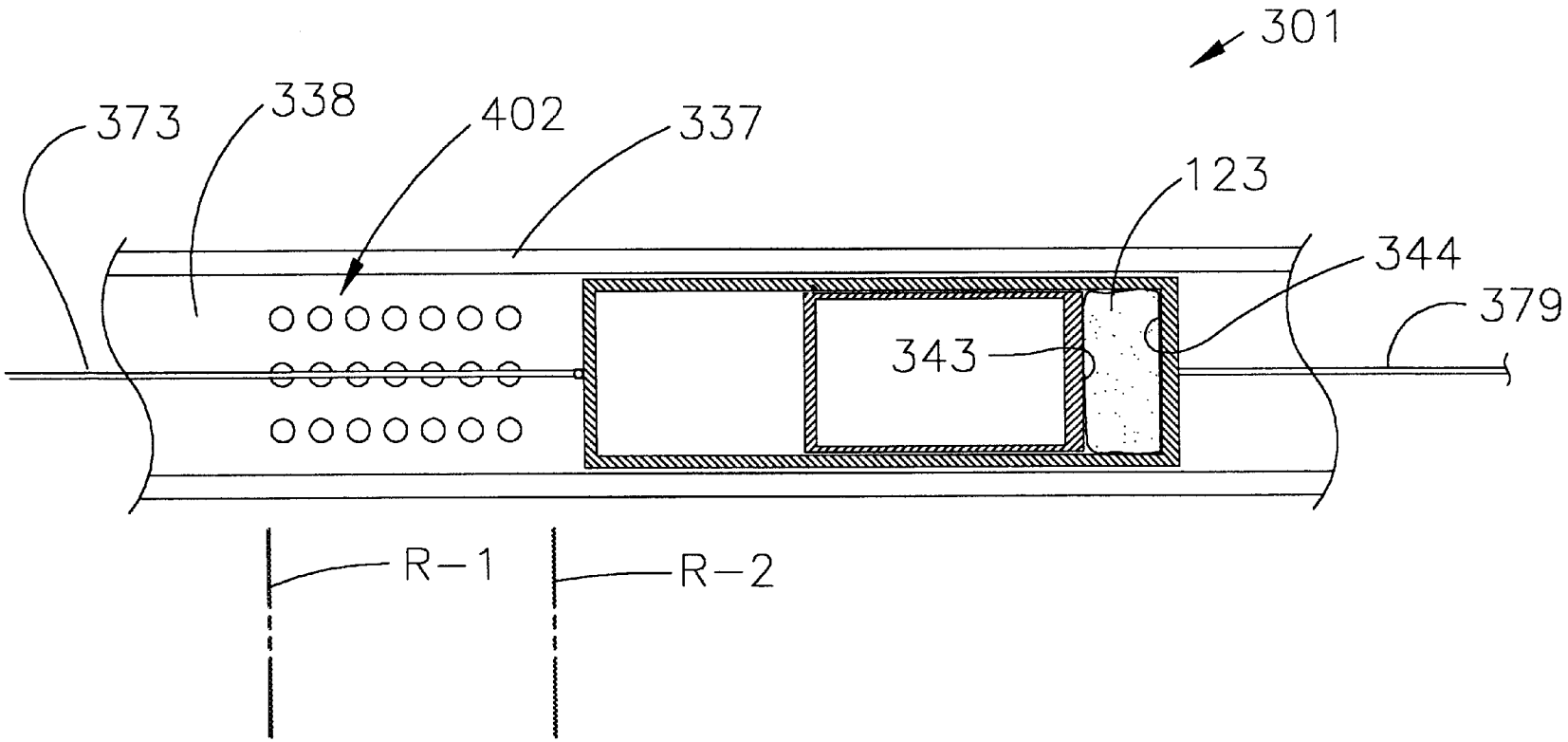
FIG. 10 is a plan view of the second embodiment of the drier illustrating the two jaws and the loaf being conveyed together to a loaf discharge station.

A second embodiment of the present invention is shown in FIGS. 7A, 7B, 8A, 8B and 9, 10, 11A, 11B, and 12 as a drier 301 for producing the loaf 123 of dry waste from the loose wet screenings 102. FIGS. 7A and 7B show a vise 324 having vise members 326. Each of the vise members 326 has a squeezer face 327. The squeezer faces 327 are opposed to each other and define an initial vise volume 328 having a length 329 parallel to a squeezing axis 331, a width 332 (FIG. 7B) perpendicular to the squeezing axis 331, and a height 333. The initial vise volume 328 defined by the squeezer faces 327 also has an open top 334 for receiving the loose wet screenings 102 and has an open bottom 336 for discharging the loaf 123 of dry waste. A platform, such as a trough, 337 is provided having a surface 338 for supporting the loose wet screenings 102 in the initial vise volume 328 between the opposed squeezer faces 327. FIGS. 8A and 8B show a driver 339 moving the vise members 326 relative to each other to immediately, without any lost motion prior to commencing the compressing, reduce the size of the initial vise volume 128 and compress the loose wet screenings 102 while the open top 334 remains open. FIGS. 9 and 10 show the former loose wet screenings 102 as the loaf 123 of dry waste having a dry volume 341 substantially less than the initial vise volume 328 of the loose wet screenings 102.

Figure 11A:
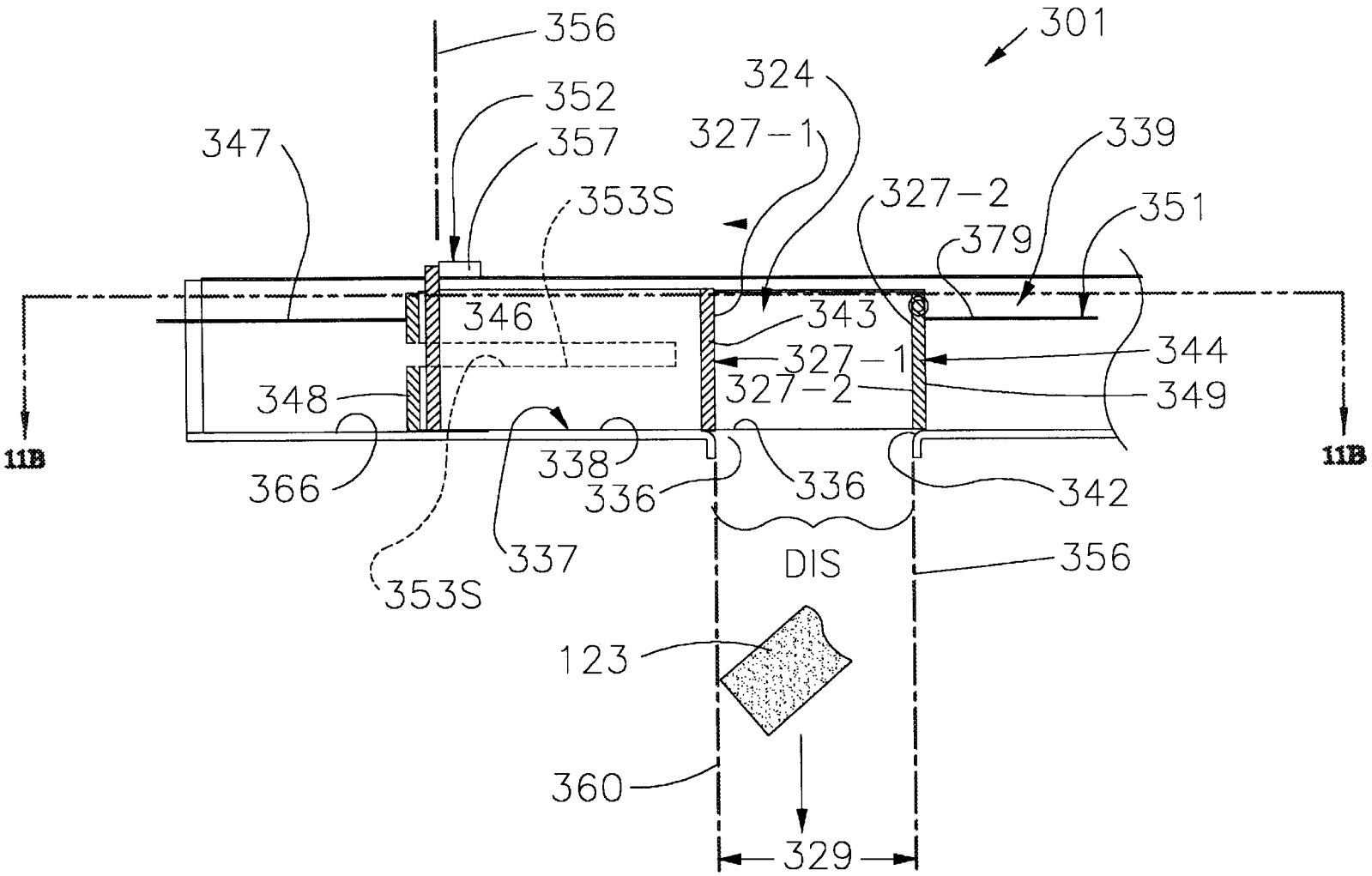
FIG. 11A is an elevational view of the second embodiment of the drier illustrating the two jaws and the loaf at the loaf discharge station, wherein the loaf is being discharged from the jaws.
Figure 11B:
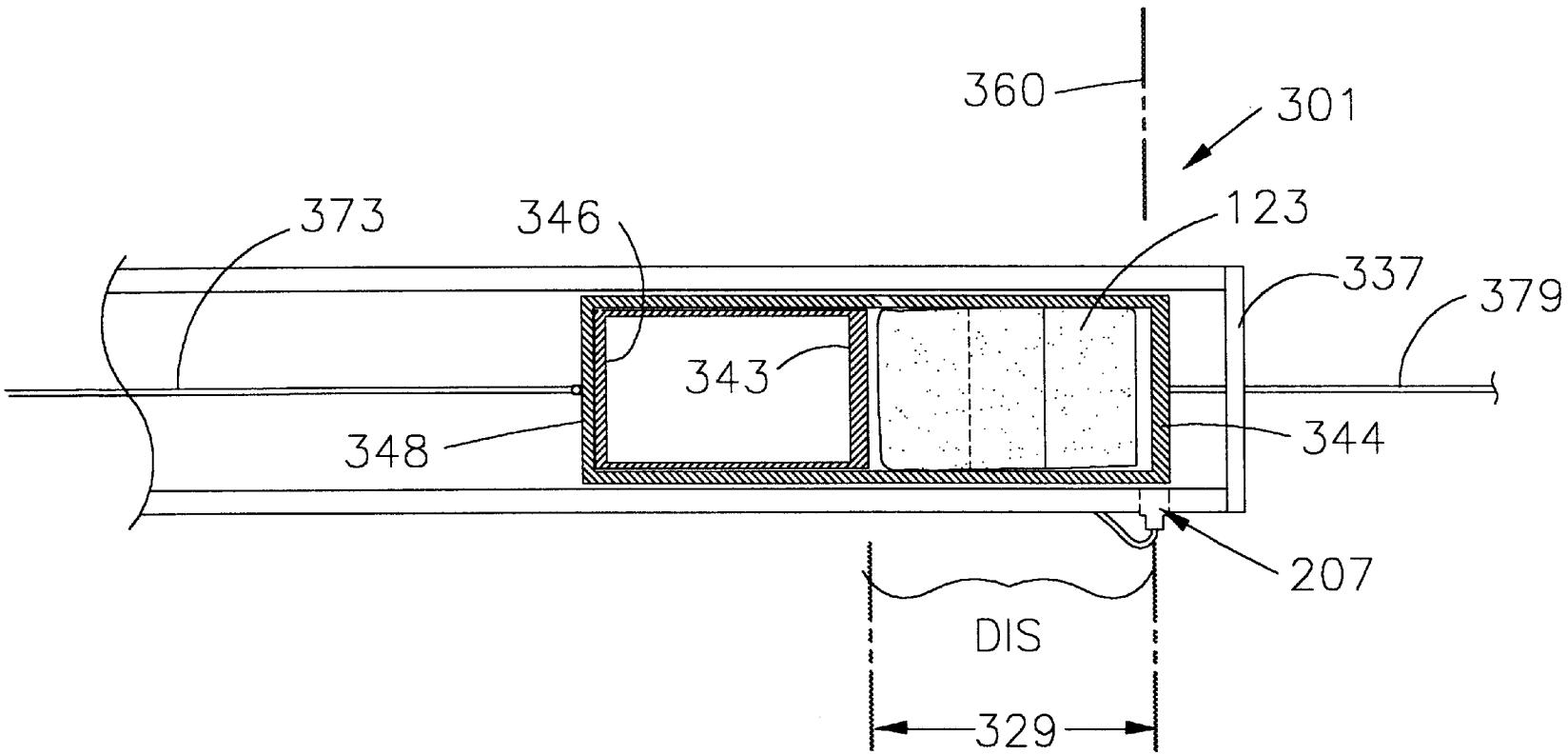
FIG. 11B is a plan view of the second embodiment of the drier taken along lines 11B—11B in FIG. 11A, illustrating a sensor for detecting the second jaw at the loaf discharge station.

In other aspects of the second embodiment, FIGS. 9 and 10 show the loaf 123 of dry waste in the form of one separate loaf 123. FIGS. 11A and 11B show the loaf 123 after it has been conveyed for discharge from the drier 301. The platform 337 has an opening 342 in the surface 338, and the opening 342 defines the open bottom 336. The driver 339 is connected to the vise members 326 for moving the vise members 326 relative to the platform 337 to align the squeezer faces 327 with the opening 342. As shown in FIG. 11A, such alignment permits the one separate loaf 123 to be discharged from the vise 324 through the open vise bottom 336 (i.e., through the opening 342 in the trough 337).

FIGS. 7A and 8A show more detail of the vises 324 of the second embodiment of the drier 301. The vise members 326 may include a first of the squeezer faces 327-1 in the form of a first jaw 343. The first jaw 343 may have a box-like shape shown in FIG. 8B. The vise member 326 may include a second of the squeezer faces 327-2 in the form of a second jaw 344. The second jaw 344 may also have a box-like shape enclosing and receiving the first jaw 343. Arms such as arms 165A (FIG. 1C) may be used to support the first jaw 343 on the second jaw 344. Alternatively, the surface 338 may directly support the first jaw 343 and the second jaw 344 for movement relative to the trough 337. Also, the jaws 343 and 344 may be movable relative to each other on the surface 338. The driver 339 includes a left drive 347 connected to a left drive end 348 of the second jaw 344. On the right, the squeezer face 327-2 of the second jaw 343 is connected to a right drive 351 of the driver 339.

Additionally, as shown in FIGS. 7B and 8B, the drier 301 may be provided with one or more stop devices 352 mounted on the platform 337. One of the stop devices 352 may, for example, include a pair of squeezer stops 353 (FIG. 7B) for limiting movement of the second jaw 344 (or the second vise member) relative to the platform 337. FIG. 7B shows that the squeezer stops 353 extend from the trough 337 into the leftward path of a left end 346 of the first jaw 343 to prevent movement of the first jaw 343 leftward past the stops 353. FIGS. 7A and 8A show that in the second embodiment of the drier 301, elongated slots 353S are provided in the second jaw 344 to allow the stops 353 to extend from the trough 337 into the leftward path of the first jaw 343. With movement of the first jaw 343 limited by the squeezer stops 353, FIG. 7B shows the left drive 347 connected to the second jaw 344 for moving the second jaw 344 relative to the first jaw 343 (e.g., to the left in FIG. 7B).

As described above, vertical lines are also used to indicate, for example, positions at which the stops 353 are located along the squeezer axis 331. Also, additional vertical lines are illustrated to define positions, or stations, along the horizontal squeezing axis 331 at which the elements of the drier 301 may be positioned. For example, certain lines designate "drier" stations at which the main functions of the drier 301 take place (e.g., receiving, squeezing, and discharge). Other lines designate "jaw" stations at which the first jaw 343 and the second jaw 344 are positioned while the drier 301 performs such main functions.

FIG. 7A shows that the squeezer stops 353 may be mounted on the platform 337 at a first stop position identified by a vertical line 354. The moving of the second jaw 343 is effective to reduce the value of the length 329 of the initial vise volume 328. For example, the large jaw-open value of length 329 in FIG. 7A is reduced to the smaller jaw-squeezing value of the length 129 in FIG. 9.

Another stop device 352 may, for example, be a releasable detent type stop device, such as a first, or receiver, detent 355 mounted on the platform 337 at a first detent position identified by a vertical line 355DR. In this case, as shown in FIGS. 7B and 8A, when the left drive 347 moves the second jaw 344 leftward against the stop 353, the first detent 355 engages the first jaw 343 to releasably hold the first jaw 343 to the platform 337. Following a leftward squeezing stroke in which the loose wet screenings 102 are formed into the loaf 123 (FIGS. 8A and 9A), there is a rightward return stroke. In an initial short portion of a long return stroke, the right drive 351 may move only the second jaw 344 to the right from the position shown in FIG. 9. During the rest of the long return stroke and before reaching the position shown in FIG. 11A, the left drive end 348 of the second jaw 344 engages the left end 346 of the first jaw 343. At this time, during a further portion of the return stroke, the rightward force of the right drive 351 overcomes the releasable holding force of the first detent 355, such that the first jaw 343 and the second jaw 344 move rightward together and with the loaf 123 to the position shown in FIG. 11A.

In one aspect of the squeezing, after the second jaw 344 has been moved through one squeezing stroke to the left to reduce the value of the length 329 of the initial vise volume 328 to the smaller jaw-squeezing value shown in FIG. 9, the squeezing may be considered complete. However, in another aspect of the squeezing, many such squeezing strokes may be taken. In this instance, after the first of such squeezing strokes, the short portion of the return stroke starts by the right drive 351 moving the second jaw 344 rightward to a position 155R. The position 155R is to the right of the position shown in FIG. 9, but the left drive end 348 of the second jaw 344 does not hit the left end 346 of the first jaw 343. The right drive 351 then stops and the left drive 347 again moves the second jaw 344 leftward against the screenings 102, and again to the fully-squeezed position shown in FIG. 9. This series of squeezing strokes and short portions of the return strokes may be repeated as many times as is necessary to form the loaf 123 as dry waste.

When the squeezing has been completed, the rightward return stroke is performed. The second jaw 344 moves rightward past the position 355R, the left drive end 348 hits the left end 346 and overcomes the detent 355, and the right return stroke continues until the left end 346 of the first jaw 343 hits a second pair of the stops 352, identified as the discharge stops 357. At this time the squeezer face 327-1 of the first jaw 343 is located at a first jaw discharge station indicated by a vertical line 360 shown in FIG. 11A. The right drive 351 continues to move the second jaw 344 (e.g., to the right) away from the first jaw 343 to a second jaw discharge position indicated by the vertical line 356. The right drive 351 stops. Such continued movement increases the value of the length 329 of the vise volume 328 to the value shown in FIGS. 11A and 11B. The first jaw 343 and the second jaw 344 are thus positioned at a discharge station DIS and thereby allow the loaf 123 to move (e.g., drop or fall) through the open bottom 336 and from between the vise (or squeezer) faces 327 to discharge the loaf 123 from the drier 301.

Figure 12:
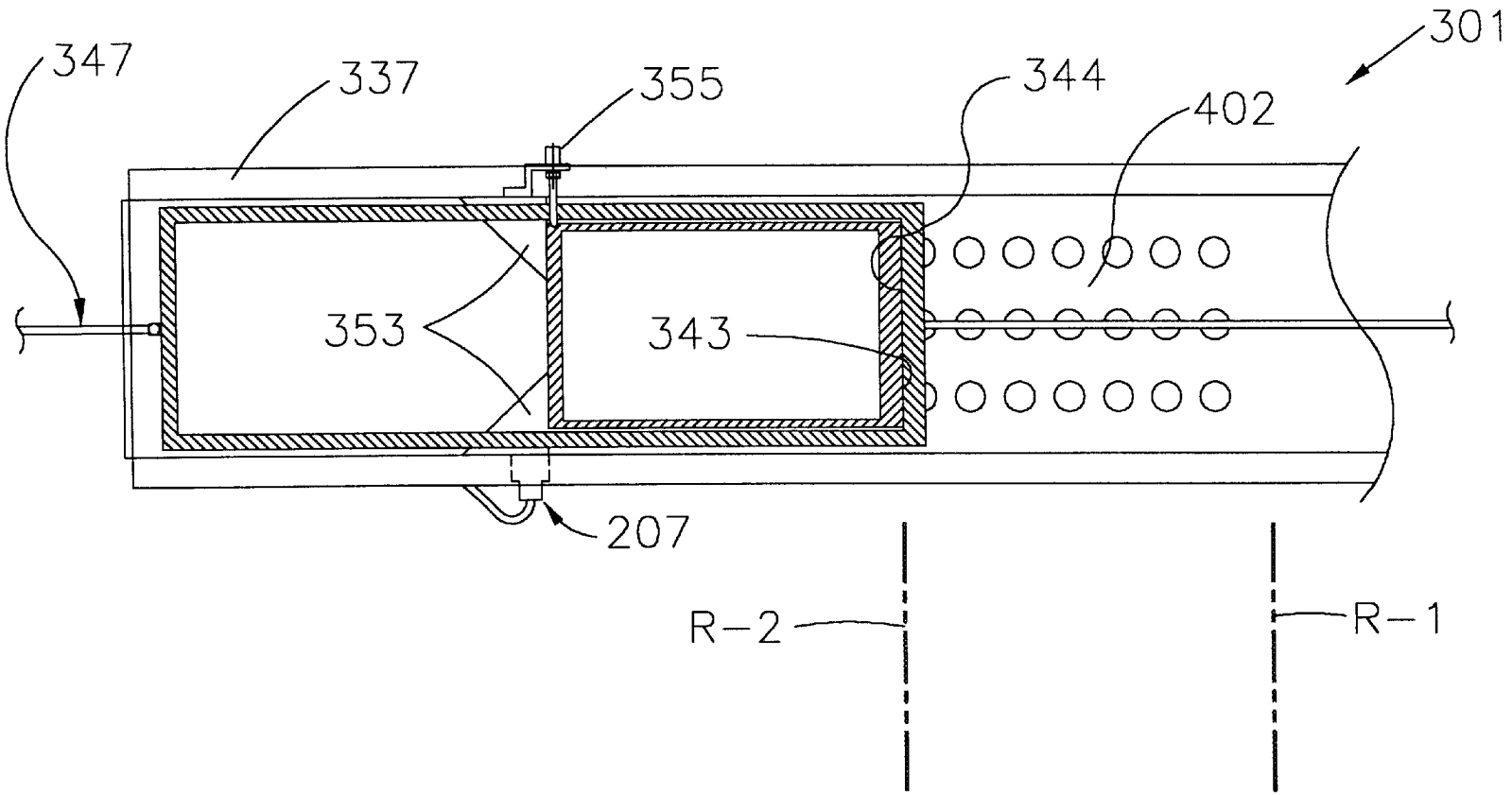
FIG. 12 is a plan view of the second embodiment of the drier illustrating the second jaw moved leftward past the receiving/squeezing station to position the first jaw against the stop and to set a releasable detent to releasably hold the first jaw to the trough in preparation for rightward movement of the second jaw to the receiving/squeezing station.
Figure 16:
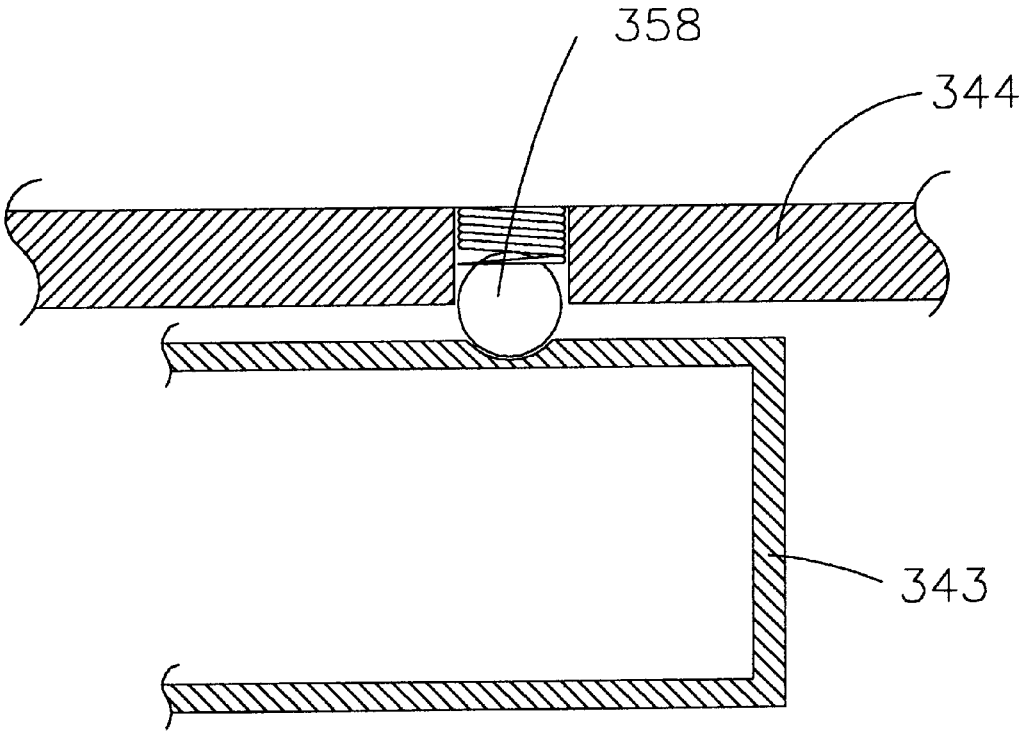
FIG. 16 is a schematic view of a detent for releasably holding the two jaws together in the jaw open position.

As shown in FIG. 16, an inter-jaw detent 358 may be provided between the first jaw 343 and the second jaw 344 to keep those jaws in the open position during the return movement to the receiving station REC/SQU. Return movement to the receiving station REC/SQU is provided by the left drive 347 which acts on the second jaw 344. Via the detent 358, the second jaw 344 moves the first jaw 343 leftward until the first jaw 344 hits the stop 353 at the position 354 (FIG. 7A). The left drive 347 stops and the first receiving detent 355 releasably engages the first jaw 343. Until the first jaw 343 hits the stop 353, the inter-jaw detent 358 holds the two jaws 343 and 344 so that the relative positioning of the jaws 343 and 344 is the jaw-open position shown in FIG. 11A ready to receive a batch 121 of the loose wet screenings 102. At the start of the squeezing stroke, the releasable holding force of the inter-jaw detent 358 is overcome such that the second jaw 344 is permitted to move toward the first jaw 343 for squeezing (as shown in FIG. 8A). Alternatively, if no inter-jaw detent 358 is used, the left drive 347 may move the second jaw 344 further leftward than shown in FIG. 8B so that the second jaw 344 urges the first jaw 343 against the stops 353 as shown in FIG. 12 so that the first jaw 343 is at a jaw station R-1. In that case, the left drive 347 then stops, the detent 355 holds the first jaw 343 against the stop 353, and the right drive 351 moves the second jaw 344 rightward to a jaw-open station R-2 at drier station REC/SQU as shown in FIGS. 7A and 7B.

As shown in FIGS. 7A–11B, the second embodiment of the present invention may provide the drier 301 for both forming and conveying the loaf 123 of dry compacted screenings 102. For the function of conveying the loaf 123, FIGS. 7A and 7B show the trough 337 with the surface 338 defining vertical tracks 362. The tracks 362 form a guide or trackway 364 extending horizontally from the first drier station (e.g., in FIGS. 7A and 7B identified by "REC/SQU", designating receiving and squeezing) to the second drier station (e.g., in FIGS. 11A and 11B identified by "DIS", designating discharge). FIGS. 7A and 7B show the first jaw 343 and the second jaw 344 received in the trough 337. The trough 337 has a U-shaped cross section defined by the tracks 362 and a bottom 366.

At the first drier station REC/SQU the screenings 102 are received between the first jaw 343 and the second jaw 344 in the loose wet form, with the first jaw 343 at the jaw station R-1 (designating the first jaw 343 at a screenings-receiving position) and the second jaw 344 at the jaw station R-2 (designating the second jaw 344 at the screenings-receiving position). To facilitate squeezing the wet loose screenings 102, the left drive 347 moves the left drive end 348 of the second jaw leftward as shown in FIGS. 8A and 8B. During squeezing of the loose wet screenings 102, the left drive 347 moves the second jaw 344 past an intermediate jaw station SI-1 (FIG. 8A, designating the second jaw 344 at the intermediate jaw station SI-1) to a jaw station SF-1 shown in FIG. 9 (designating the second jaw 344 at a fully squeezed position). The detent 355 and the squeezing force hold the first jaw 343 at the jaw station R-1. For conveying, both jaws 343 and 344 are moved from the respective jaw stations R-1 and SF-1 to respective jaw stations 360 and 356 (FIG. 11A) which define the second, or discharge, drier station DIS of the drier 301. At the second drier station DIS the dry separate loaf 123 moves from the drier 301.

To facilitate conveying the loaf 123 to the second drier station DIS, the jaws 343 and 344 are carried by the surface 338 of the trough 337. Also, under the action of the right drive 351, the first jaw 343 is movable with the second jaw 344 relative to the trough 337 from the respective jaw stations R-1 and SF-1 shown in FIG. 9 to the respective jaw stations 360 and 356 shown in FIG. 11A.

In this squeezing and conveying embodiment, the driver 339 may include the two (e.g., the left and right) respective drives 347 and 351. The drives 347 and 351 are connected to the second jaw 344 for moving the second jaw 344 and the first jaw 343 together (i.e., at the same time) and relative to the first drier station REC/SQU and relative to the second drier station DIS. The driver 339 includes the left drive 347 connected to the left drive end 348 of the second jaw 344. On the right, FIG. 7A shows the second jaw 344 supported by the trough 337 (via the surface 338) and connected to the right drive 351. FIGS. 7A and 8A show each of the left drive 347 and the right drive 351 as including a respective left cable 373 and right cable 379. In the manner described above for the drive 139, and as shown in FIG. 15, the common motor 183 rotates the left reel 176 and the right reel 182 at the same time and in the same direction, and the left cable 373 (rather than the illustrated cable 173) and the right cable 379 (rather than the illustrated cable 179) are wound in opposite directions around the respective reels 176 and 182. In this manner, as the reels 176 and 182 are rotated in the same direction, one cable, such as the left cable 373, is taken up and the other cable, such as the right cable 379, is payed out. Such taking up of the left cable 373 moves the structure of the drier 301 from the positions shown in FIGS. 7A to the fully-squeezed positions shown in FIG. 9. The motor 183 then stops, and the direction of rotation reverses, so that the right cable 379 is taken up and the left cable 373 is payed out. Such taking up of the right cable 379 moves the drier elements from the fully-squeezed positions shown in FIG. 9 to the discharge positions shown in FIGS. 11A and 11B, at which time the motor 183 stops, and the direction of rotation again reverses, so that the left cable 373 is again taken up and the right cable 379 is again payed out as described above until the jaws 343 and 344 are positioned as shown in FIGS. 7A and 7B at jaw stations R-1 and R-2 to receive the loose wet screenings 102.

The detent 355 has the same structure as the detent 155, and to avoid duplicate description, is not described again.

Another embodiment of the present invention may provide the drier 301 for use with the screen 103 for removing the screenings 102 from the channel 104 through which the screenings 102 flow in the liquid 107. The screen 103 moves the screenings 102 in the loose wet condition out of the liquid 107 to a position above the channel 104. The trough 337 is mounted between the drier 301 and the channel 104 and is vertically aligned with the channel 104. The platform 337 has the surface 338 for supporting the loose wet screenings 102 in the screenings-receiving volume 328 between the opposed squeezer faces 327 and for supporting the loaf 123. The platform 337 is also perforated at the drier station REC/SQU to define a sieve-like section 402 (FIG. 10) of the surface 338 which permits the liquid 107 to flow out of the screenings-receiving volume 328 into the channel 104. In addition, the driver 339 moves the squeezer faces 327 relative to each other to reduce the size of the screenings-receiving volume 328 and squeeze the loose screenings 102 so that the liquid 107 in the squeezed screenings 102 may flow directly from the sieve-like section 402 into the channel 104 without flowing through a next batch 121 of the screenings 102 removed from the channel 104 after the prior squeezed batch 121.

In another aspect of the drier 301, the controller 206 may be used to control the driver 339. The controller 206 causes the driver 339 to move the first jaw 343 and the second jaw 344 toward each other at the station REC/SQU to squeeze the loose wet screenings 102 and to define the loaf 123. The controller 206 causes the driver 339 to move the first jaw 343 and the second jaw 344 away from each other (as at the station DIS) to permit the loaf 123 to move from the drier 301. The controller 206 may respond to the sensors 207 in the manner described above with respect to the drier 101.

It is to be understood that the scope of the present invention is to be defined by the appended claims, and not limited by the foregoing description, which describes presently preferred ways in which the present invention may be devised and still come within the scope of the present invention.

What is claimed is:

1. A drier for producing dry waste from loose wet screenings, said drier comprising:

a vise having vise members, each of the vise members having a squeezer face;

the squeezer faces being opposed to each other and defining an initial vise volume having an open top for receiving the loose wet screenings and having an open bottom for discharging one loaf;

a platform having a surface for supporting the loose wet screenings in the initial vise volume between the opposed squeezer faces; and a drive for moving the vise members relative to each other to immediately reduce the size of the initial vise volume and to compress the loose wet screenings to produce the dry waste while the open top remains open and without any lost motion prior to commencing the compressing.

2. A drier according to claim 1, wherein the dry waste is in the form of one loaf of screenings, which loaf is also conveyed, the drier further comprising:

the platform having an opening in the surface; and the drive being connected to the vise members for moving the vise members relative to the platform to align the squeezer faces with the opening and permit one loaf to be discharged from the vise through the open bottom and through the opening.

3. A drier according to claim 1, further comprising:

the vise members comprising a first jaw and a second jaw;

the second jaw carrying the first jaw for movement relative to the second jaw; and the second jaw being movably mounted on the platform.

4. A drier according to claim 3, further comprising:

at least one stop mounted on the platform for limiting movement of the second jaw relative to the platform; and with movement of the second jaw being limited by the at least one stop, the drive being connected to the first jaw for moving the first jaw relative to the second jaw.

5. A drier according to claim 4, wherein:

the at least one stop is mounted on the platform at a first position; and the moving of the first jaw is effective to reduce the value.

6. A drier according to claim 4, wherein the moving of the first jaw relative to the second jaw forms the loose wet screenings into a loaf of dry waste;

the at least one stop is mounted on the platform at a second position; and the moving of the first jaw is away from the second jaw to increase the size of the vise volume and allow the loaf to move through the open bottom and from between the vise faces.

7. A drier according to claim 4, further comprising:

the at least one stop comprising first and second stops, the first stop being mounted on the platform at a first position adjacent to a screenings receiving station of the platform, and the second stop being mounted on the platform adjacent to a loaf discharging station;

with movement of the second jaw being limited by the first stop, the drive being effective to move the first jaw to reduce the size of the vise volume and squeeze the loose wet screenings to form one loaf of dry waste;

with movement of the second jaw being limited by the second stop, the drive being effective to move the first jaw away from the second jaw to increase the size of the vise volume and allow the loaf to move through the open bottom and from between the squeezer faces.

8. A drier for squeezing screenings to define a loaf of dry screenings in the form of a three dimensional dry mass, and for conveying the loaf, the drier comprising:

a vise provided with first and second jaws, each of the jaws having a vise plate provided with a vise face, the vise faces being opposed to each other; and a guide connected to the second jaw and having a guide track extending from a first station to a second station, at the first station the screenings being received between the first and second jaws in a form that is loose and wet relative to the form of the loaf, at the second station the loaf moving from the drier;

the first jaw being carried by the second jaw and being movable with the second jaw relative to the guide to convey the loaf;

the first jaw being carried by the second jaw and mounted for movement relative to the second jaw to form the loaf from the loose and wet screenings.

9. A drier according to claim 8, further comprising:

a drive connected between the first and second jaws for moving the first and second jaws together and relative to the first and second stations; and a stop mechanism mounted on the guide, the mechanism comprising a stop for engagement with the second jaw adjacent to the first station to hold the second jaw against movement relative to the guide and cause the first jaw moving relative to the guide to form the loaf.

10. A drier according to claim 8, further comprising:

a drive connected between the first and the second jaws for moving the first jaw relative to the first station and relative to second station; and a stop mechanism mounted on the guide, the stop mechanism comprising a first stop for engagement with the second jaw adjacent to the second station to prevent movement of the second jaw past the second station and cause the first jaw moving relative to the guide to move away from the second jaw and permit the loaf to move from the drier.

11. A drier according to claim 8, further comprising:

the vise faces being spaced and each having two dimensions so that between the vise faces a screenings-receiving volume is defined, the screenings receiving-volume being reduced in size upon movement of the first jaw relative to the second jaw to define a squeezed volume, each of the screenings-receiving volume and the squeezed volume having an open top to permit the reception of the screenings between the first and second jaws.

12. A drier according to claim 8, further comprising:

the vise faces being spaced and each having two dimensions so that between the vise faces a screenings-receiving volume is defined, the screenings receiving-volume being reduced in size upon movement of the first jaw relative to the second jaw to define a squeezed volume, each of the screenings-receiving volume and the squeezed volume having an open bottom to permit the loaf to move from between the first and second jaws.

13. A drier according to claim 8, further comprising:

the guide being provided with a floor beneath the first and second jaws to maintain the screenings between the first and second jaws so that the movement of the first jaw relative to the second jaw forms the loaf from the loose and wet screenings received between the first and second jaws.

14. A drier conveyor according to claim 13, further comprising:

the floor being open at the second station to permit the loaf that moves from between the first and second jaws to move from the press.

15. A drier according to claim 8, wherein the drier receives loose batches of the screenings from a screen at a rate that may vary over time, and wherein the rate at which a given loose batch of screenings is formed into the loaf and conveyed to the second station is independent of the rate at which the screen supplies the screenings to the drier, the drier further comprising:

a drive connected between the first jaw and the second jaw for moving the first jaw relative to the first and second stations so that the loaf moves from the drier before an additional batch of screenings is supplied from the screen.

16. A drier according to claim 8, further comprising:

a drive connected to the second jaw for moving the second jaw relative to the first and second stations; and a releasable detent between the guide and the first jaw, the releasable detent releasably holding the first jaw adjacent to the first station and enabling the second jaw moving relative to the guide to move away from the first jaw and permit the screenings to be received between the first and second jaws in the loose and wet form.

17. A drier according to claim 8, wherein guide is provided with a third station in a given direction from the first station, the drier further comprising:

a drive connected to the second jaw for moving the second jaw relative to the first and second stations;

a stop extending from the guide to prevent movement of the first jaw past the first station in a first direction; and a releasable detent between the second jaw and the first jaw, the releasable detent releasably holding the first jaw for movement with the second jaw relative to the guide, the releasable detent being overcome upon the first jaw being stopped by the stop to permit the drive to move the second jaw from the first station toward the third station.

18. A drier according to claim 8, further comprising:

the carrying of the first jaw by the second jaw allowing the first and second jaws to move relative to each other to a jaw-open position;

a drive connected to the second jaw for moving the second jaw relative to the first and second stations and relative to a third station, the first station being a screenings-receiving station, the second station being a dry-complete station, and the third station being spaced from the screenings-receiving station in a direction opposite to the direction of the dry-complete station from the first station;

the moving including moving from the second dry-complete station toward the first screenings-receiving station; and a releasable detent between the first jaw and the guide, the releasable detent releasably holding the first jaw against movement with the second jaw relative to the guide, the releasable detent being overcome upon the first and second jaws being in the jaw-open position to permit the first and second jaws to move relative to the guide toward the third station.

19. A drier according to claim 8, further comprising:

a drive connected to the second jaw for moving the second jaw relative to the first and second stations, the relative movement comprising movement to the second station;

a stop extending from the guide to prevent movement of the first jaw in a first direction past the second station; and a releasable detent between the second jaw and the first jaw, the releasable detent releasably holding the first jaw for movement with the second jaw relative to the guide, the releasable detent being overcome upon the first jaw being stopped by the stop, the overcoming permitting the drive to move the second jaw relative to the guide to the second station and away from the first jaw to permit the loaf to move from the press.

20. A drier according to claim 8, further comprising:

the carrying of the first jaw by the second jaw allowing the first and second jaws to move relative to each other to a jaw-open position;

a drive connected between the first jaw and the second jaw for moving the first jaw relative to the first and second stations and relative to a third station, the first station being a screenings-receiving station, the second station being a dry-complete station, and the third station being spaced from the screenings-receiving station in a direction opposite to the direction of the dry-complete station from the first station;

the moving of the first jaw including moving from the second dry-complete station toward the first screenings-receiving station; and a releasable detent between the first jaw and the second jaw, the releasable detent releasably holding the first jaw against movement relative to the second jaw;

a stop secured to the guide for engaging the second jaw and overriding the releasable detent to permit the first jaw to move toward the second jaw and squeeze the screenings.

21. A drier according to claim 8, further comprising:

a drive connected between the first and second jaws for moving the jaws relative to the first and second stations;

a stop extending from the guide to prevent movement of the second jaw in a first direction past the second station; and a releasable detent between the second jaw and the first jaw, the releasable detent releasably holding the first and second jaws together for movement relative to the guide, the releasable detent being overcome upon the second jaw being stopped by the stop, the overcoming permitting the drive to move the first jaw relative to the second jaw and relative to the guide to the second station with the vise plate of the first jaw moving away from the vise plate of the second jaw to permit the loaf to move from the press.

22. A drier for use with a screen for removing screenings from a channel through which the screenings flow in liquid, the screen moving the screenings in a loose and wet condition out of the liquid to a position above the channel; the drier squeezing the loose and wet screenings to define a three dimensional dry mass of screenings in the form of a loaf of screenings, the drier comprising:

a vise having vise members, each of the vise members having a vise face, the vise faces being mounted above and vertically aligned with the channel, the vise faces being opposed to each other and defining a receiver volume having an open top for receiving the loose screenings and having an open bottom for discharging one loaf and the liquid removed from the loose and wet screenings;

a drive for moving the vise members relative to each other to reduce the size of the receiving volume, to squeeze the loose and wet screenings to form the loaf while the open top remains open, and to remove the liquid from the screenings; and a platform mounted between the drier and the channel and vertically aligned with the channel, the platform having a surface for supporting the loose and wet screenings in the receiving volume between the opposed faces and for supporting the loaf, the platform being perforated to permit the liquid to flow out of the receiving volume.

23. A drier according to claim 22, wherein the screen removes the screenings from the channel in separate batches, further comprising:

the drive moving the vise faces relative to each other into a spaced position to define the receiver volume for receiving a batch of the screenings;

the reduction of the size of the receiver volume by the drive being effective to squeeze the loose screenings so that the liquid in the squeezed screenings flows directly into the channel without flowing through a next batch of the screenings removed from the channel after the squeezed batch of screenings.

24. A drier according to claim 22, wherein upon removal from the channel the screenings have undesirable material thereon, the drier further comprising:

a sprayer for directing clean liquid onto the loose and wet screenings before the squeezing operation of the vise so that the undesirable material is removed from the screenings and flows directly into the channel without first flowing onto other previously squeezed screenings that have been removed from the channel.

25. A drier-conveyor for defining and moving a loaf of dry screenings in the form of a three dimensional compressed mass, the drier-conveyor comprising:

a vise provided with first and second jaws, each of the jaws having a vise plate provided with a vise face, the vise faces being opposed to each other;

a guide connected to the second jaw and having a guide track extending from a first station to a second station, at the first station the guide being continuous to support the screenings between the first and second jaws in a form that is loose and wet as compared to the dry compressed form of the loaf, the guide being discontinuous at the second station to permit the loaf to move from the vise at the second station;

the first jaw being carried by the second jaw for movement with the second jaw relative to the guide;

a drive connected at least to the second jaw to move the first and second jaws along the guide; and a controller for the drive, the controller causing the drive to move the first and second jaws toward each other at the first station to squeeze the loose and wet screenings and to define the loaf, the controller causing the first and second jaws to move away from each other at the second station to permit the loaf to move from the drier.

26. A drier-conveyor according to claim 25, wherein a third station is provided to define the position of the first jaw when the loaf has been defined, the controller further comprising:

a barrier on the guide in the path of the second jaw for stopping the second jaw adjacent to the first station; and a sensor responsive to the first jaw at the third station for reversing the direction of motion of the first jaw.

27. A drier-conveyor according to claim 25, wherein a fourth station is provided to define the position of the first jaw when the loaf is positioned at the second station, the controller further comprising:

a barrier on the guide in the path of the second jaw for stopping the second adjacent to the second station; and a sensor responsive to the first jaw at the fourth station for reversing the direction of motion of the first and second jaws.

28. A drier-conveyor according to claim 25, the controller further comprising:

a first barrier on the guide in the path of the second jaw for stopping the second jaw adjacent to the first station; and a second barrier on the guide in the path of the second jaw for stopping the second jaw adjacent to the second station.

29. A drier-conveyor according to claim 28, wherein a third station is provided to define the location of the first jaw when the loaf has been defined and a fourth station is provided to define the location of the first jaw when the loaf is positioned at the second station, the controller further comprising:

a sensing devise responsive to the first jaw positioned at either of the third and fourth stations for reversing the direction of the drive.

30. A drier-conveyor for defining and moving a loaf of screenings in the form of a three dimensional compressed dry mass, the drier-conveyor comprising:

a vise provided with first and second jaws, each of the jaws having a vise plate provided with a vise face, the vise faces being opposed to each other;

a guide having a guide track extending along a first station, a second station, a third station, a fourth station, and a fifth station;

the respective first and second jaws being spaced apart when at the respective first and second stations and when at the respective third and fourth stations;

between the first and second stations the guide being perforated to support the screenings between the first and second jaws in a form that is loose and wet with liquid while allowing the liquid to drain from the screenings;

the guide being discontinuous between the third and fourth stations to permit the loaf to be discharged from the drier;

the first jaw being received in the second jaw for movement with the second jaw relative to the guide;

a drive connected between the first and the second jaws to move the jaws along the guide; and a controller for the drive, the controller causing the drive to move the first and second jaws relative to each other and relative to the guide.

31. A drier-conveyor according to claim 30, the controller further comprising:

the controller causing the drive to move the second jaw from the fourth station toward the fifth station; and a detent connecting the first jaw to the guide to hold the first jaw at the first station as the second jaw moves from the fifth station toward the second station.

32. A drier-conveyor according to claim 31, the controller further comprising:

the controller causing the drive to move the second jaw from the fifth station past the second station toward the fourth station; and as the second jaw moves from the fifth station past the second station toward the fourth station the detent releasing the first jaw to permit the first jaw to move with the second jaw toward the fourth station.

33. A drier-conveyor according to claim 30, further comprising:

a first stop in the path of the first jaw for stopping the first jaw at the third station while the second jaw moves to the fourth station; and a detent for releasably connecting the first jaw to the second jaw upon the arrival of the second jaw at the fourth station.

34. A drier-conveyor according to claim 33, further comprising:

a second stop in the path of the first jaw to override the detent and interrupt motion of the first jaw at the first station.

35. A drier-conveyor according to claim 34, wherein the screenings are supplied to the drier-conveyor between the first and second jaws, the controller further comprising:

the controller causing the second jaw to move past the second station toward the first station with the first jaw stopped by the second stop so that the screenings between the first jaw and the second jaw are squeezed to define the loaf.

36. A drier for producing dry waste from loose wet screenings, said drier comprising:

vise means having vise members provided with squeezer faces;

means for mounting the squeezer faces opposed to each other to define an initial vise volume having an open top for receiving the loose wet screenings and to define an open bottom for discharging one loaf;

platform means having a surface for supporting the loose wet screenings in the initial vise volume between the opposed squeezer faces and drive means for moving the vise members relative to each other to immediately reduce the size of the initial vise volume and compress the loose wet screenings to produce the dry waste while the open top remains open and without any lost motion prior to commencing the compressing.

37. A drier for producing dry waste from loose wet screenings, wherein the dry waste is in the form of one loaf of screenings and the one loaf is also conveyed, the drier comprising:

vise means having vise members provided with squeezer faces;

means for mounting the squeezer faces opposed to each other to define an initial vise volume having an open top for receiving the loose wet screenings and to define an open bottom for discharging the one loaf;

platform means having a surface for supporting the loose wet screenings in the initial vise volume between the opposed squeezer faces, the platform means having an opening in the surface; and drive means for moving the vise members relative to each other to immediately reduce the size of the initial vise volume and compress the loose wet screenings to produce the dry waste while the open top remains open and without any lost motion prior to commencing the compressing, the drive means being connected to the vise members for moving the vise members relative to the platform means to align the squeezer faces with the opening and permit the one loaf to be discharged from the vise means through the open bottom and through the opening.

38. A drier for squeezing screenings to define a loaf of dry screenings in the form of a three dimensional dry mass, and for conveying the loaf, the drier comprising:

vise means provided with first and second jaws, each of the jaws having a vise plate provided with a vise face, the vise faces being opposed to each other for squeezing the screenings; and means connected to the second jaw and having a guide track extending from a first station to a second station for guiding the first and second jaws from the first station to the second station, at the first station the screenings being received between the first and second jaws in a form that is loose and wet relative to the form of the loaf, at the second station the loaf moving from the drier;

the first jaw being carried by the second jaw and being movable with the second jaw relative to the guide for conveying the loaf;

the first jaw being carried by the second jaw and mounted for movement relative to the second jaw for forming the loaf from the loose and wet screenings.

39. A drier for use with a screen for removing screenings from a channel through which the screenings flow in liquid, the screen moving the screenings in a loose and wet condition out of the liquid to a position above the channel; the drier squeezing the loose and wet screenings to define a three dimensional dry mass of screenings in the form of a loaf of screenings, the drier comprising:

vise means having vise members provided with vise faces, the vise faces being mounted above and vertically aligned with the channel and being opposed to each other for defining a receiver volume having an open top to receive the loose screenings and having an open bottom to discharge one loaf and the liquid removed from the loose and wet screenings;

drive means for moving the vise members relative to each other to reduce the size of the receiving volume, to squeeze the loose and wet screenings to form the loaf while the open top remains open, and to remove the liquid from the screenings; and platform means mounted between the drier and the channel and vertically aligned with the channel, the platform means having a surface for supporting the loose and wet screenings in the receiving volume between the opposed faces and for supporting the loaf, the platform means being perforated for permitting the liquid to flow out of the receiving volume.

40. A drier-conveyor for defining and moving a loaf of screenings in the form of a three dimensional compressed dry mass, the drier-conveyor comprising:

vise means provided with first and second jaws, each of the jaws having a vise plate provided with a vise face, the vise faces being opposed to each other for squeezing the screenings;

guide means connected to the second jaw and having a guide track extending from a first station to a second station to a third station to a fourth station to a fifth station;

the respective first and second jaws being spaced apart when at the respective first and third stations and when at the respective fourth and fifth stations;

between the first, second and third stations the guide means being perforated to support the screenings between the first and second jaws in a form that is loose and wet with liquid while allowing the liquid to drain from the screenings;

the guide means being discontinuous between the fourth and the fifth stations for permitting the loaf to be discharged from the drier;

the first jaw being carried by the second jaw for movement with the second jaw relative to the guide;

drive means connected between the first and the second jaws for moving the jaws along the guide means; and controller means for causing the drive means to move the first and second jaws relative to each other and relative to the guide means.

* * * * *